US010636247B2

(12) United States Patent
Kukita et al.

(10) Patent No.: US 10,636,247 B2
(45) Date of Patent: Apr. 28, 2020

(54) PLAYER TRACKING DEVICE AND GAMING MACHINE

(71) Applicant: Universal Entertainment Corporation, Tokyo (JP)

(72) Inventors: Noritoshi Kukita, Tokyo (JP); Yuya Konno, Tokyo (JP); Jun Haishima, Tokyo (JP); Shigehiko Kitagawa, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 85 days.

(21) Appl. No.: 15/506,340

(22) PCT Filed: Aug. 17, 2015

(86) PCT No.: PCT/JP2015/073038
§ 371 (c)(1),
(2) Date: Feb. 24, 2017

(87) PCT Pub. No.: WO2016/031609
PCT Pub. Date: Mar. 3, 2016

(65) Prior Publication Data

US 2017/0278347 A1 Sep. 28, 2017

(30) Foreign Application Priority Data

Aug. 28, 2014 (JP) ..... 2014-174506

(51) Int. Cl.
*G07F 17/32* (2006.01)
*G07F 17/34* (2006.01)

(52) U.S. Cl.
CPC ..... *G07F 17/3239* (2013.01); *G07F 17/3213* (2013.01); *G07F 17/3218* (2013.01);
(Continued)

(58) Field of Classification Search
CPC ..... G07F 17/32; G07F 17/3241
See application file for complete search history.

(56) References Cited

U.S. PATENT DOCUMENTS

2004/0110557 A1* 6/2004 Rowe ..... G06Q 20/02 463/25
2008/0207335 A1* 8/2008 DiMichele ..... G07F 17/32 463/46

(Continued)

FOREIGN PATENT DOCUMENTS

JP 2006-116111 5/2006
JP 2006-280798 10/2006

(Continued)

*Primary Examiner* — David L Lewis
*Assistant Examiner* — Robert E Mosser
(74) *Attorney, Agent, or Firm* — Lew IP Meister, PLLC

(57) ABSTRACT

Provided is a player tracking device which is operable, even when an IC card is taken into a gaming machine while a player is playing a game, to read or write information from or to another IC card or the like through a simplified touch operation. The player tracking device includes: a card unit for storing information pertinent to a play outcome on the gaming machine in an IC card through wireless communication; and a touch unit for reading information from another IC card through the wireless communication.

7 Claims, 17 Drawing Sheets

(52) U.S. Cl.
CPC ..... *G07F 17/3227* (2013.01); *G07F 17/3246* (2013.01); *G07F 17/3288* (2013.01); *G07F 17/34* (2013.01)

(56) References Cited

U.S. PATENT DOCUMENTS

| | | | | |
|---|---|---|---|---|
| 2010/0120486 | A1* | 5/2010 | DeWaal | G07F 17/32 463/16 |
| 2013/0053129 | A1* | 2/2013 | LeMay | G07F 17/3223 463/25 |
| 2013/0217466 | A1 | 8/2013 | Fujisawa | |

FOREIGN PATENT DOCUMENTS

| | | |
|---|---|---|
| JP | 2012-034480 | 2/2012 |
| JP | 2012-071053 | 4/2012 |
| JP | 2013-165901 | 8/2013 |
| WO | 2014/038382 | 3/2014 |

* cited by examiner

FIG.9

SYMBOL COMBINATION TABLE

| SYMBOL COMBINATION | | | | | PAYOUT NUMBER | WINNING COMBINATION |
|---|---|---|---|---|---|---|
| 1ST VIDEO REEL | 2ND VIDEO REEL | 3RD VIDEO REEL | 4TH VIDEO REEL | 5TH VIDEO REEL | | |
| **RED** | **RED** | **RED** | **RED** | **RED** | **15** | **RED** |
| APPLE | APPLE | APPLE | APPLE | APPLE | **12** | **APPLE** |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE3 |
| CHERRY | CHERRY | CHERRY | (ANY) | (ANY) | 2 | CHERRY2 |
| ORANGE | ORANGE | ORANGE | (ANY) | (ANY) | 2 | ORANGE2 |
| CHERRY | (ANY) | (ANY) | (ANY) | (ANY) | 1 | CHERRY1 |
| ORANGE | (ANY) | (ANY) | (ANY) | (ANY) | 1 | ORANGE1 |

PLAYER TRACKING DEVICE AND GAMING MACHINE

TECHNICAL FIELD

The present invention relates to a player tracking device which is incorporated into a gaming machine.

BACKGROUND ART

Conventionally, there has been proposed a game system which is operable to conduct a game by using an information card, instead of a paper type method, on gaming machines. Each of the gaming machines which this game system has includes: a bill validator which identifies bills whose currency kinds are different from one another and a money amount of said bill or bills and outputs data indicating a result of the identification; a player tracking device which converts the data outputted from the bill validator to credit data for executing a game based on an exchange rate internally stored and transmits the credit data to a gaming machine; a control device to which an exchange rate is inputted externally and which updates an exchange rate stored in the player tracking device by providing the inputted exchange rate for the player tracking device; and an information card device which causes the information card to store data corresponding to a money amount awarded to a player in accordance with an outcome of the game played on the gaming machine and based on the data corresponding to the money amount read out from the information card to the gaming machine, transmits credit data for executing a game (refer to Patent Literature 1).

Here, the above-described player tracking device is mounted so as to be integrated into each of the gaming machine and is a device for realizing a player tracking system (PTS). The player tracking system is a system which causes an IC card to store an identification information unique to a player (a person who plays a game on a gaming machine) and allows a player to carry this IC card with him or her as an IC card unique to said player and to use this IC card, thereby enabling a player to be identified and managed on a terminal to which this IC card is inserted. When a player inserts the IC card (player card) into the player tracking device, information such as a balance or the like in an account of said player is displayed on a display device or the like of the player tracking device, a game is executed on a gaming machine based on credit data managed by the IC card, and a credit obtained as an outcome of the game is added for the player identified by said IC card.

The player tracking device as described above includes one IC card reader/writer for conducting reading and writing for the IC card and further, a card suction and ejection mechanism for taking in internally the IC card while a player is playing a game. When a player makes settlement, these device and mechanism allow credit information to be written onto the IC card, and the IC card having the credit information written thereon to be ejected externally from a card slot.

CITATION LIST

Patent Literature

Patent Literature 1: U.S. Patent Application Publication No. 2012/0135799

SUMMARY OF THE INVENTION

Technical Problem

However, because while a player is playing a game, the IC card is taken inside of the gaming machine by the card suction and ejection mechanism, the gaming machine disclosed in Patent Literature 1 is not operable to read or write information from or to another IC card or the like.

Solution to Problem

The present invention provides a player tracking device and a gaming machine, described below.

In view of the above-described regard, the present invention has been made. Objects of the present invention are to provide a player tracking device which is operable, even when an IC card is taken into a gaming machine while a player is playing a game, to read or write information from or to another IC card or the like through a simplified touch operation; and a gaming machine.

A player tracking device (for example, a PTS terminal 1700 shown in FIG. 8) according to a first aspect of the present invention has the below-described configuration.

The player tracking device is integrated into a gaming machine (for example, a slot machine 1010 shown in FIG. 4) and includes:

- a card unit (for example, a card unit 1741 shown in FIG. 8) including an IC card writer for storing information pertinent to a play outcome on the gaming machine (for example, credit-related data) in an IC card (for example, an IC card 1500) through wireless communication; and
- a touch unit (for example, a touch unit 1745 shown in FIG. 8) including an IC device reader for reading information from an IC device (for example, an IC card 1500 or a mobile phone) including an IC chip through the wireless communication,
- a controller (for example, a controller 1750) of the player tracking device executing processes described below:
- a process (A) in which the card unit is controlled to taken in and hold the IC card during a game play on the gaming machine; and
- a process (B) in which in response to approaching of the IC device, the touch unit is controlled to read the information from the IC device.

By employing the above-described configuration, on the player tracking device being integrated into the gaming machine, which includes: the card unit including the IC card writer for storing the information pertinent to the play outcome on the gaming machine in the IC card through the wireless communication; and the touch unit including the IC device reader for reading the information from the IC device including the IC chip through the wireless communication, the card unit is controlled to taken in and hold the IC card during the game play on the gaming machine; and in response to the approaching of the IC device, the touch unit is controlled to read the information from the IC device. Thus, even when the IC card is taken into the gaming machine while a player is playing a game, it is made possible to read or write the information from or to another IC card or the like through the simplified touch operation.

In the first aspect, the player tracking device according to a second aspect of the present invention further has the below-described configuration.

The information read from the IC device is information pertinent to maintenance for the gaming machine.

By employing the above-described configuration, the player tracking device reads the information pertinent to the maintenance for the gaming machine from the IC device. Thus, even when the IC card is taken into the gaming machine while a player is playing a game, it is made possible to conduct the maintenance for the gaming machine by using another IC card or the like.

A gaming machine according to a third aspect of the present invention has the below-described configuration.

The gaming machine on which based on rearranged symbols (for example, symbols 1501 of pseudo reels 1151 to 1155), a payout is awarded includes:

a display device (for example, a lower image display panel 1141) for displaying a plurality of reels (for example, the pseudo reels 1151 to 1155), each of the reels having a plurality of symbols depicted on an external surface;

a cabinet (for example, a cabinet 1011) for internally housing the display device;

a controller (for example, a controller 1100) for rotating and stopping the plurality of reels and controlling the symbols depicted on the plurality of reels to be rearranged; and the player tracking device according to the first aspect which is incorporated into the cabinet.

By employing the above-described configuration, the gaming machine includes the player tracking device according to the first aspect, the card unit is controlled to take in and hold the IC card during the game play on the gaming machine, and the touch unit is controlled, in response to the approaching of the IC device, to read the information from the IC device. Thus, even when the IC card is taken into the gaming machine while a player is playing a game, it is made possible to read or write the information from or to another IC card or the like through the simplified touch operation.

A player tracking device according to a fourth aspect of the present invention has the below-described configuration.

The player tracking device is integrated into a gaming machine and includes:

a card unit (for example, a card unit 1741 shown in FIG. 8) including an IC card reader for reading information stored in an IC card through wireless communication; and a USB terminal (for example, a USB terminal 1737 shown in FIG. 8) to which an electronic device is connected, a controller of the player tracking device executing processes described below:

a process (A) in which based on the information in the IC card read by the card unit, whether or not the IC card is an IC card of a member is determined; and a process (B) (for example, a USB control part 1759 is controlled to supply power from a power supply unit 1760 to a USB terminal 1737) in which when the IC card is determined to be the IC card of the member, control is performed such that power is supplied to the USB terminal and the electronic device connected to the USB terminal is caused to be in a rechargeable state.

By employing the above-described configuration, on the player tracking device being integrated into the gaming machine, which includes: the card unit including the IC card reader for reading the information stored in the IC card through the wireless communication; and the USB terminal to which the electronic device is connected, based on the information in the IC card read by the card unit, whether or not the IC card is the IC card of the member is determined; and when the IC card is determined to be the IC card of the member, the control is performed such that the power is supplied to the USB terminal and the electronic device connected to the USB terminal is caused to be in the rechargeable state. Thus, when a player has become a member, the player can enjoy the benefit in that the electronic device can be recharged by the USB terminal, whereby entry into membership by players of the gaming machines can be promoted.

A gaming machine according to a fifth aspect of the present invention has the below-described configuration.

The gaming machine on which based on rearranged symbols, a payout is awarded includes:

a display device for displaying a plurality of reels, each of the reels having a plurality of symbols depicted on an external surface;

a cabinet for internally housing the display device;

a controller for rotating and stopping the plurality of reels and controlling the symbols depicted on the plurality of reels to be rearranged; and the player tracking device according to claim 4 which is incorporated into the cabinet.

By employing the above-described configuration, the gaming machine includes the player tracking device according to the fourth aspect, based on the information in the IC card read by the card unit, it is determined whether or not the IC card is the IC card of the member, and when the IC card is determined to be the IC card of the member, the control is performed such that the power is supplied to the USB terminal and the electronic device connected to the USB terminal is caused to be in the rechargeable state. Thus, when a player has become a member, the player can enjoy the benefit in that the electronic device can be recharged by the USB terminal, whereby entry into membership by players of the gaming machines can be promoted.

A player tracking device according to a sixth aspect of the present invention has the below-described configuration.

The player tracking device is integrated into a gaming machine and includes:

a display device (for example, an LCD 1719 shown in FIG. 8) for displaying information pertinent to service related to a game executed on the gaming machine; and a button (for example, a home button 1722 shown in FIG. 8) for shifting a screen displayed on the display device to other screen, a controller of the player tracking device executing processes described below:

a process (A) in which a position of a touch operation onto the display device (a touch operation onto a touch panel of the LCD 1719 shown in FIG. 8) is detected, and at this point in time, the screen displayed on the display device is shifted to the other screen in accordance with the position on the display device (for example, a process of returning to a menu screen 30 shown in FIG. 16B when a "return" button display part 38 of a top menu 34 for restaurant reservation shown in FIG. 16C is touched); and a process (B) in which when the button is pressed, at this point in time, display on the display device is shifted to a predetermined upper level screen related to the screen displayed on the display device (for example, a process of returning to the top menu 34 for the restaurant reservation shown in FIG. 16C when the home button 1722 is pressed while a confirmation screen 38*e* shown in FIG. 17 is displayed).

By employing the above-described configuration, on the player tracking device being integrated into the gaming machine, which includes: the display device for displaying the information pertinent to the service related to the game executed on the gaming machine; and the button for shifting the screen displayed on the display device to the other screen, the position of the touch operation onto the display device is detected, and at this point in time, the screen displayed on the display device is shifted to the other screen in accordance with the position on the display device; and when the button is pressed, at this point in time, the display on the display device is shifted to the predetermined upper level screen related to the screen displayed on the display device. Thus, it is not required to arrange a button on the display device of the player tracking device, and no overload is exerted on a display area of the display device. In addition, jumping to the fixed screen by pressing the button is conducted, thereby allowing a sense of ease to be imparted to a player who hesitates over an operation.

A gaming machine according to a seventh aspect of the present invention has the below-described configuration.

The gaming machine on which based on rearranged symbols, a payout is awarded includes:

- a display device for displaying a plurality of reels, each of the reels having a plurality of symbols depicted on an external surface;
- a cabinet for internally housing the display device;
- a controller for rotating and stopping the plurality of reels and controlling the symbols depicted on the plurality of reels to be rearranged; and
- the player tracking device according to claim 6 which is incorporated into the cabinet.

By employing the above-described configuration, the gaming machine includes the player tracking device according to the sixth aspect, the position of the touch operation onto the display device is detected and at this point in time, the screen displayed on the display device is shifted to the other screen in accordance with the position on the display device, and when the button is pressed, at this point in time, the display on the display device is shifted to the predetermined upper level screen related to the screen displayed on the display device. Thus, it is not required to arrange a button on the display device of the player tracking device, and no overload is exerted on a display area of the display device. In addition, jumping to the fixed screen by pressing the button is conducted, thereby allowing a sense of ease to be imparted to a player who hesitates over an operation.

Effects of the Invention

By employing the configuration of the gaming machine according to the present invention, even when the IC card is taken into the gaming machine while a player is playing a game, it is made possible to read or write information from or to another IC card or the like through the simplified touch operation. For example, in order to conduct maintenance or the like for a gaming machine while a player is playing a game, the touch unit is touched with an IC card for maintenance, thereby allowing a screen for the maintenance to be displayed on an LCD of the PTS terminal and contents and a history of the maintenance to be transmitted to a server and be accumulated therein.

BRIEF DESCRIPTION OF THE DRAWINGS

FIG. 9 is a diagram showing an example of a symbol combination table which the slot machine according to the one embodiment of the present invention includes.

DESCRIPTION OF EMBODIMENTS

A first embodiment of the present invention will be described with reference to the accompanying drawings.

[Description of Outline of Game System]

Figure 1:
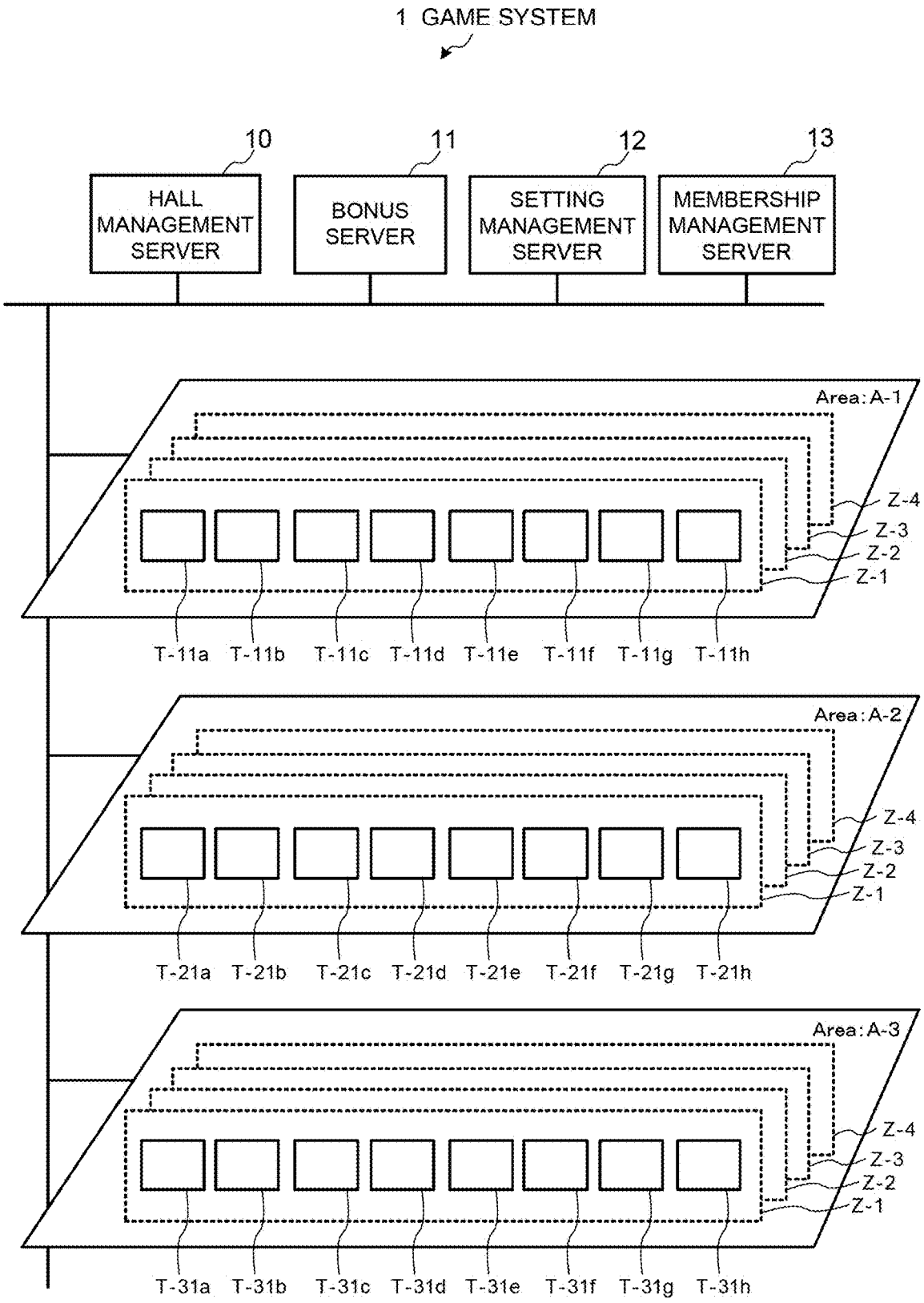
FIG. 1 is a diagram schematically illustrating a game system according to one embodiment of the present invention.

First, with reference to FIG. 1, an outline of a game system will be described. FIG. 1 is a schematic diagram schematically illustrating an overview of the game system 1 according to the first embodiment of the present invention.

The game system 1 includes: a hall management server 10, a bonus server 11, a setting management server 12, a membership management server 13, and a plurality of gaming machines.

The hall management server 10 totalizes and manages a flow of money within a hall (game facility), prepares a balance sheet and the like, and manages the other servers. In addition, the hall management server 10 obtains, from the respective gaming machines, accounting information which includes timing at which each of the gaming machines starts a unit game; timing at which each of the gaming machines terminates the unit game; a drawing result in the unit game; and the like and accumulates the accounting information.

The bonus server 11 controls a bonus drawing in a bonus game and linkage presentation conducted in association with the bonus drawing. In addition, the bonus server 11, for example, manages an accumulated value for providing a bonus (for example, credits accumulated for a progressive bonus). The setting management server 12 stores and manages setting related to gaming machines, on each of which the bonus drawing is conducted, and setting related to the linkage presentation. It is to be noted that although in the present embodiment, the description is given by taking the bonus game as an example, other kinds of games may be conducted.

The membership management server 13 is a server which stores and manages personal information of members, membership card (IC card) information, the past game outcomes of the members, and the like. Issuance of membership cards (IC cards) is made by, for example, a membership card issuing terminal. The personal information of the members, inputted upon member registration, is stored on the membership management server 13 together with identification codes of the membership cards. In addition, the membership card issuing terminal is provided with a camera which allows also shooting of a face of a player for which an IC card is issued upon issuing of a membership card. The shot image is stored on the membership management server 13 so as to be associated with an identification code.

As shown in FIG. 1, the gaming machines are installed in a plurality of areas (for example, as shown in FIG. 1, A-1 to A-3). Here, the areas correspond to, for example, one floor of a hall or areas within the floor. In this example, although the areas from A-1 to A-3 are shown, this is merely one example.

Further, the gaming machines are installed in each zone (for example, as shown in FIG. 1, in Z-1 to Z-4) within each of the areas. Here, each of the zones corresponds to specific space within each of the areas. In this example, although the four zones (Z-1 to Z-4) are provided in each of the areas, respectively, this is also merely one example. In addition, in this example, although eight gaming machines are installed in each one of the zones, respectively, this is also merely one example, and various numbers of the gaming machines can be installed.

As shown in FIG. 1, in the zone Z-1 of the area A-1, eight gaming machines of T-11*a* to T-11*h* are installed; similarly, in the zone Z-2 of the area A-1, eight gaming machines of T-12*a* to T-12*h* are installed (thereinafter, not shown); in the zone Z-3 of the area A-1, eight gaming machines of T-13*a* to T-13*h* are installed; and in the zone Z-4 of the area A-1, eight gaming machines of T-14*a* to T-14*h* are installed.

Further, as shown in FIG. 1, in the zone Z-1 of the area A-2, eight gaming machines of T-21*a* to T-21*h* are installed; similarly, in the zone Z-2 of the area A-2, eight gaming machines of T-21*a* to T-22*h* are installed (thereinafter, not shown); in the zone Z-3 of the area A-2, eight gaming machines of T-23*a* to T-23*h* are installed; and in the zone Z-4 of the area A-2, eight gaming machines of T-24*a* to T-24*h* are installed. In addition, in the zone Z-1 of the area A-3, eight gaming machines of T-31*a* to T-31*h* are installed; similarly, in the zone Z-2 of the area A-3, eight gaming machines of T-32*a* to T-32*h* are installed (thereinafter, not shown); in the zone Z-3 of the area A-3, eight gaming machines of T-33*a* to T-33*h* are installed; and in the zone Z-4 of the area A-3, eight gaming machines of T-34*a* to T-34*h* are installed.

It is to be noted that although it is schematically shown that the respective gaming machines are connected to the hall management server 10 and the bonus server 11 via a LAN connection by Ethernet (a registered trademark), the more detailed connection form will be described later.

In addition, each of the gaming machines is provided with a unique identifier, and the hall management server 10 or the like identifies transmission sources of data transmitted from the respective gaming machines by using the identifiers. In addition, also in a case where the hall management server 10 or the like transmits data to the gaming machines, based on the identifiers, transmission destinations are specified. Although as the identifiers, for example, network addresses such as IP addresses can be used, identifiers other than the network addresses may be provided, thereby allowing the individual gaming machines to be managed.

It is to be noted that the game system 1 may be constructed within one hall (game facility) where various games can be conducted or may be constructed over a plurality of game facilities. In addition, when the game system 1 is constructed in a single game facility, the game system 1 may be constructed in each floor or section of the game facility. A communication line for connecting the servers and the gaming machines may be a wired or wireless line and can adopt a dedicated line, an exchange line, or the like.

[Description of Outline of Gaming Machine]

Figure 2:
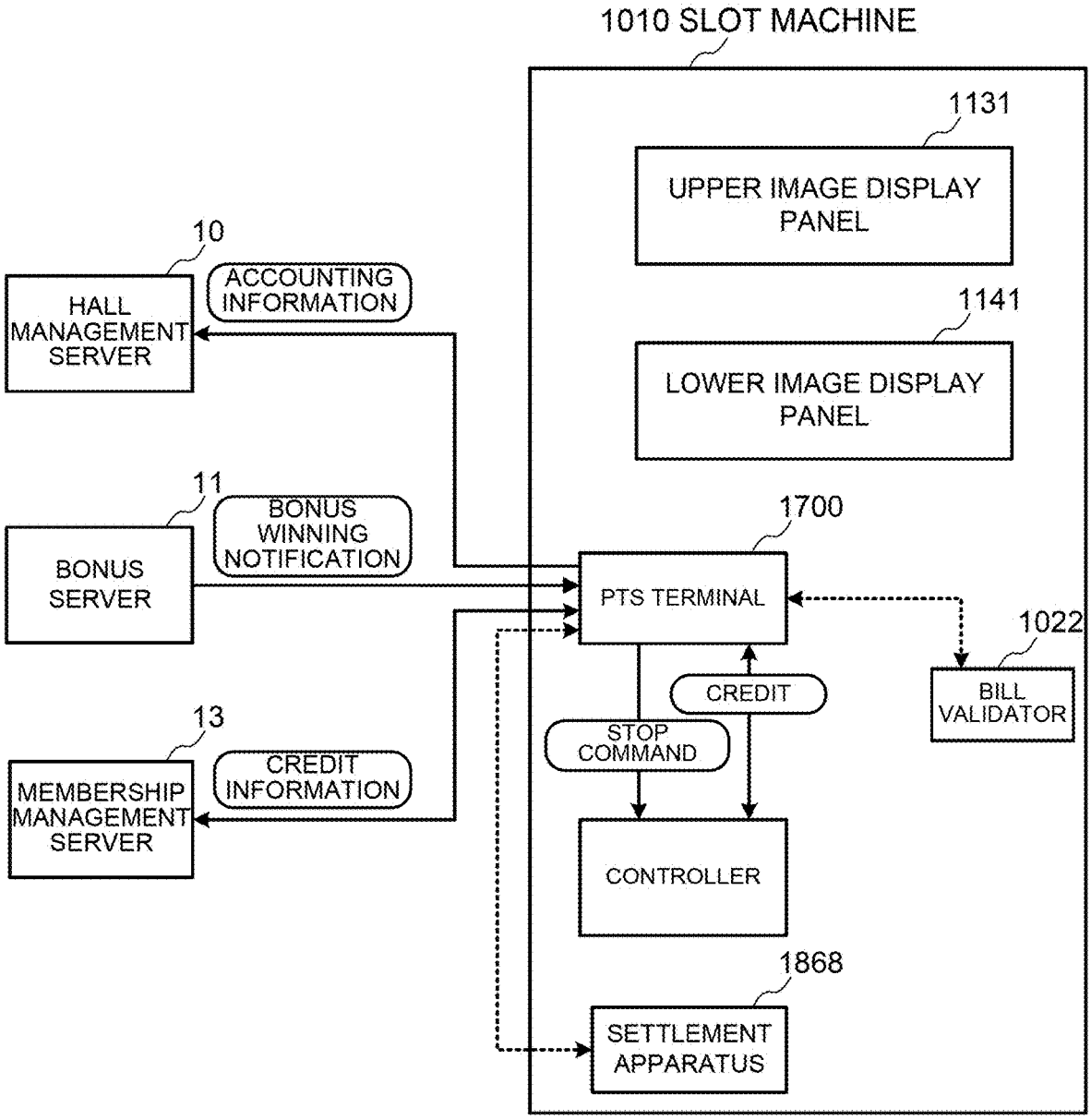
FIG. 2 is a diagram schematically illustrating a slot machine according to the one embodiment of the present invention.

Next, with reference to FIG. 2, an outline of a gaming machine according to the embodiment of the present invention will be described. In FIG. 2, a configuration of a slot machine 1010 which is a gaming machine configured integrally with a player tracking device (Player Tracking Device) is conceptually shown. It is to be noted that the player tracking device is a terminal for realizing a player tracking system (Player Tracking System) and in the present specification, hereinafter, this device is referred to as a PTS terminal. It is to be noted that although in the below description, a case where the slot machine is used as the gaming machine will be described, the present invention is not limited to the case of the slot machine and is applicable to a gaming machine which conducts a variety of games.

As shown in FIG. 2, the slot machine 1010 has the PTS terminal 1700 mounted therein and further includes a settlement apparatus 1868. The slot machine 1010 is connected via the PTS terminal 1700 to the hall management server 10, the bonus server 11, and the like via a network. In the present embodiment, one slot machine 1010 is provided with one PTS terminal 1700 mounted in one part of a housing thereof.

In the present embodiment, the PTS terminal 1700 is connected to a bill validator 1022 via a communication line (or the slot machine 1010).

In addition, based on a predetermined protocol, the PTS terminal 1700 conducts transmission and reception of data to and from a controller (the later-described controller 1100 of the slot machine 1010) and conducts data communication with the hall management server 10, the bonus server 11, and the like connected via the network. For example, from the PTS terminal 1700 to the controller, information pertinent to a credit required to start a game, a stop command to instruct to stop a unit game upon linkage presentation, and the like can be transmitted, and from the gaming controller to the PTS terminal 1700, information pertinent to a credit as a game outcome, start notification of the unit game, and termination notification thereof can be transmitted.

In addition, from the PTS terminal 1700 to the hall management server 10, the start notification and the termination notification of the unit game, accounting information including a drawing result or the like, and the like are transmitted. From the bonus server 11 to the PTS terminal 1700 (of a predetermined slot machine 1010), bonus winning notification is transmitted. Further, between the PTS terminal 1700 and the membership management server 13, information pertinent to credits of members or the like is communicated.

Here, an outline of a game flow in a case of members is as described below. First, member registration is conducted by using the membership card issuing terminal, and at this time, a membership card (IC card) is issued. Thereafter, a player inserts the membership card into the PTS terminal 1700 of the slot machine 1010 and inputs cash there. When a bill or bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller.

Based on the credit transmitted from the PTS terminal 1700, the controller executes the game. A credit in accordance with a game outcome is transmitted from the controller to the PTS terminal 1700, calculation for paying-out based on the game outcome is performed on the PTS terminal 1700, and a money amount to be paid out to a player is determined. On the PTS terminal 1700, the determined money amount is written onto the membership card as it is, and the membership card is ejected. In addition, in accordance with the execution or the like of the game, predetermined points are provided for the membership card.

In a case where a player who is a member plays a game next, the PTS terminal 1700 reads the inserted membership card and then reads out the money amount stored in the membership card. The read-out money amount is converted to a credit and the converted credit is transmitted to the controller. A credit in accordance with a game outcome is transmitted from the controller to the PTS terminal 1700 as mentioned above, calculation for paying-out based on the game outcome is performed on the PTS terminal 1700, and a money amount to be paid out to a player is determined. At this time, the money amount obtained as the game outcome is added to the money amount of the membership card, thereby updating this.

Further, at this time, the PTS terminal 1700 transmits an identification code (or a member ID) read out from the membership card and the updated money amount to the membership management server 13, and the membership management server 13 adds the money amount transmitted from the PTS terminal 1700 to a money amount of a member identified by the above-mentioned identification code and stores said money amount. By conducting this processing, the money amount which the member holds is invariably managed.

Thereafter, if needed, a player who is a member can make settlement at a cashier counter or the like, based on the money amount stored on the membership card. In addition, as in the above-described slot machine 1010, in a case where the settlement apparatus 1868 is included therein, on said slot machine 1010, the settlement can be made by using the membership card.

On the other hand, an outline of a game flow in a case where a player is a non-member is as described below. A player inputs cash to the PTS terminal 1700 of the slot machine 1010. When the bill or bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller.

Based on the credit transmitted from the PTS terminal 1700, the controller executes the game. A credit in accordance with a game outcome is transmitted from the controller to the PTS terminal 1700, calculation for paying-out based on the game outcome is performed on the PTS terminal 1700, and a money amount to be paid out to a player is determined. On the PTS terminal 1700, this determined money amount is written onto a new IC card stocked in the slot machine 1010, and the IC card is ejected. Here, the non-member gets the IC card for the first time.

Thereafter, if needed, a player who is the non-member can make settlement at a cashier counter or the like based on the money amount stored on the IC card. In addition, as in the above-described slot machine 1010, in a case where the settlement apparatus 1868 is included therein, on said slot machine 1010, the settlement can be made by using the IC card.

[Description of Function Flow Diagram]

Figure 3:
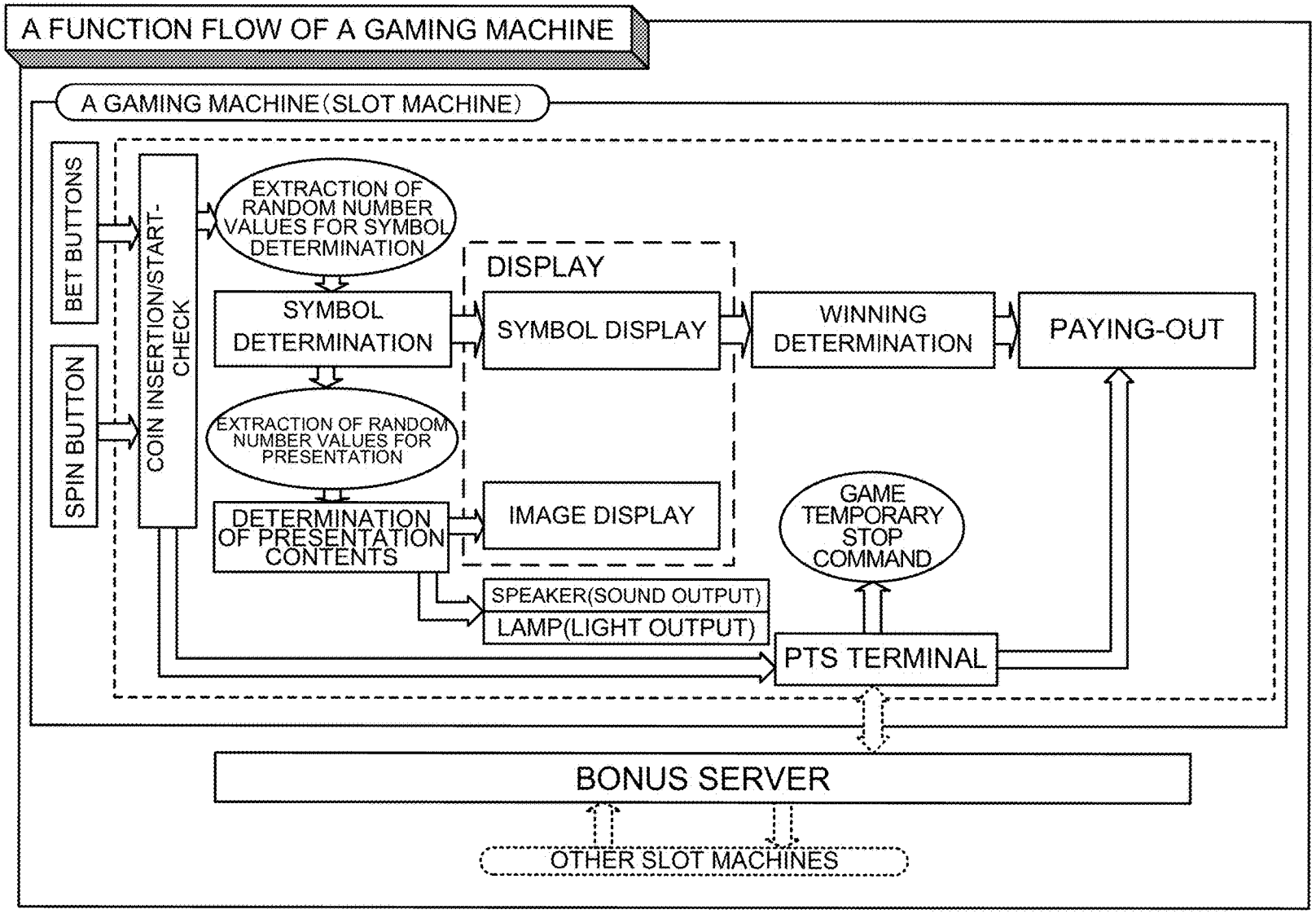
FIG. 3 is a diagram showing basic functions of the slot machine according to the one embodiment of the present invention.

With reference to FIG. 3, basic functions of a slot machine according to one embodiment of the present invention will be described. As shown in FIG. 3, the slot machine 1010 is connected to an external control device (for example, a bonus server 11) so as to allow data communication, and the external control device is connected to a plurality of other slot machines 1010 installed in a hall so as to allow data communication.

<Coin-Insertion/Start-Check>

First, the slot machine 1010 checks whether or not a BET button has been pressed by a player and subsequently checks whether or not a spin button has been pressed by a player.

<Symbol Determination>

Next, when the spin button has been pressed by a player, the slot machine 1010 extracts random number values for symbol determination and determines symbols to be displayed to a player with respect to a plurality of video reels displayed on a display at the time of stopping scrolling of symbol arrays.

<Symbol Display>

Next, the slot machine 1010 starts scrolling of the symbol array of each of the video reels and then stops the scrolling such that the determined symbols are displayed to a player.

<Winning Determination>

Next, when the scrolling of each of the video reels has been stopped, the slot machine 1010 determines whether or not a combination of symbols displayed to a player is a combination related to winning.

<Paying-Out>

Next, when the symbols displayed to a player is the combination related to the winning, the slot machine 1010 provides a benefit according to the combination for a player. For example, when a combination of symbols related to paying-out of coins has been displayed, the slot machine 1010 pays out to a player a number of coins corresponding to the combination of symbols.

In addition, on the slot machine 1010, in a case where the spin button has been pressed by a player and a unit game has been thereby started and in a case where the unit game has been terminated, in response thereto, a drawing for a bonus game is conducted on the bonus server 11. When as an outcome of the drawing for the bonus game, winning has occurred on any of the slot machines 1010, the unit game is stopped on the slot machine 10 and thereafter, linkage presentation is conducted on the PTS terminals 1700. Here, the unit game refers to a series of operations conducted from when the acceptance of betting is started to when winning is likely to be established.

On any of the slot machines 1010 which has won in the bonus game, paying-out is conducted from the bonus server 11 via the PTS terminal 1700. In addition, the bonus server 11 accumulates, for example, one part of a credit consumed by a player on each of the slot machines 1010 as a credit, for example, for a progressive bonus and when any of the slot machines 1010 has won in the bonus game, pays out one part of the progressive bonus to that slot machine 1010.

<Determination of Presentation>

The slot machine 1010 conducts presentation through displaying of images by a display, outputting of light by a lamp, and outputting of sound by a speaker. The slot machine 1010 extracts a random number value for the presentation and determines presentation contents based on symbols or the like determined by a drawing.

In addition, upon the drawing for the bonus game, the linkage presentation is conducted over the plurality of gaming machines by display devices, light emitting parts, and speakers of the PTS terminals 1700.

[Overall Structure of Slot Machine]

Figure 4:
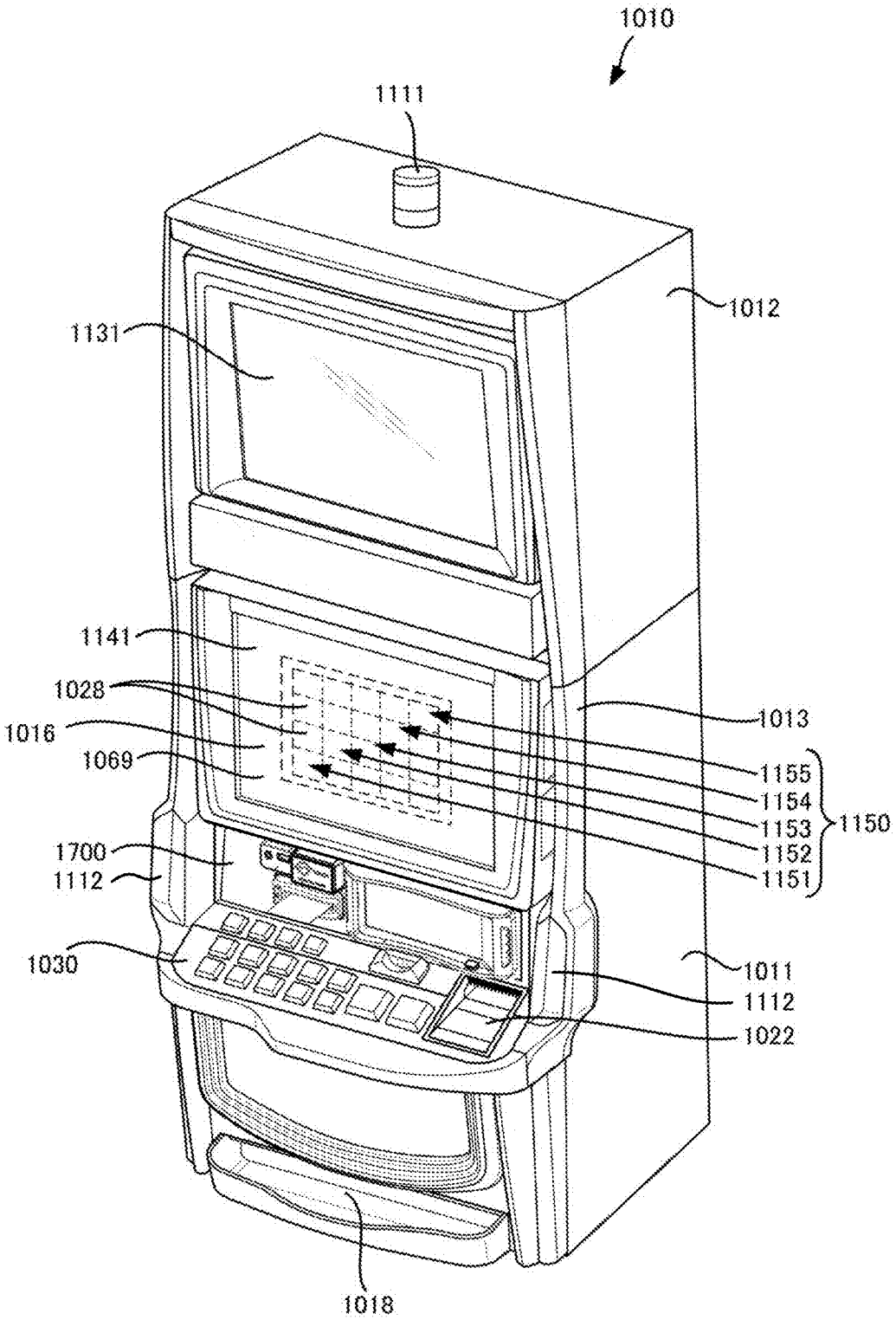
FIG. 4 is a view illustrating an overall structure of the slot machine according to the one embodiment of the present invention.

Next, with reference to FIG. 4, an overall structure of a slot machine 1010 will be described.

On the slot machine 1010, as game media, coins, bills, or electronic valuable information corresponding to these are used. In particular, in the present embodiment, credit-related data such as cash data stored in an IC card 1500 is used.

The slot machine 1010 includes: a cabinet 1011; a top box 1012 attached on an upper side of the cabinet 1011; and a main door 1013 provided on a front face of the cabinet 1011.

On the main door 1013, a symbol display device 1016 which is referred to as a lower image display panel 1141 is provided. The symbol display device 1016 is formed of a transparent liquid crystal panel. A screen which the symbol display device 1016 displays has a display window 1150 in the central portion thereof. The display window 1150 is constituted of 20 display blocks 1028 of 5 columns×4 rows. Four display blocks 1028 of each of the columns form each of pseudo reels 1151 to 1155 and are rotated in response to an operation by a player. The respective pseudo reels 1151 to 1155 allow rearrangement of symbols such that the four display blocks 1028 of each thereof are displayed in a downwardly moving manner while wholly changing a speed, thereby rotating symbols 1501 displayed in the respective display blocks 1028 in a longitudinal direction and thereafter, the rotation is stopped.

Here, the "rearrangement" means a state in which after the arrangement of the symbols 1501 has been released, the symbols 1501 are arranged again. "Arrangement" means a state in which the symbols 1501 can be visually confirmed by an external player. The slot machine 1010 executes the so-called slot game in which based on the state of the arrangement of the symbols 1501 on the pseudo reels 1151 to 1155 which have been rotated and thereafter stopped, a payout in accordance with a predetermined combination is awarded.

It is to be noted that although in the present embodiment, a case where the slot machine 1010 is the so-called video slot machine is described, on the slot machine 1010 according to the present invention, the so-called mechanical reels may be substituted for one part of the pseudo reels 1151 to 1155.

Further, on a front face of the symbol display device 1016, a touch panel 1069 is provided, and a player operates the touch panel 1069, thereby allowing a variety of instructions to be inputted. An input signal is transmitted from the touch panel 1069 to a main CPU 1071.

On a front face of the top box 1012, an upper image display panel 1131 is provided. The upper image display panel 1131 is constituted of a liquid crystal panel and configures a display. The upper image display panel 1131 displays images related to presentation and images showing introduction of contents of games and rules thereof. In addition, on the top box 1012, speakers 1112 and a lamp 1111 are provided. On the slot machine 1010, presentation in a unit game is executed through displaying of images, outputting of sound, and outputting of light.

In addition, above the display window 1150, a number-of-credits display part (not shown) is displayed and a current number of credits is displayed therein. Here, "credits" are virtual game media on a game, to be used when a player makes betting. It is to be noted that in the number-of-credits display part, a total number of credits which a player currently has is displayed.

In addition, below the number-of-credits display part, a fraction cash display part (not shown) is displayed. In the fraction cash display part, fraction cash is displayed. The "fraction cash" is cash which is not converted to a credit because an inputted money amount is insufficient.

When the IC card 1500 is inserted into the later-described PTS terminal 1700, a number of credits stored on the IC card is displayed on the number-of-credits display part, and fraction cash stored on the IC card is displayed on the fraction cash display part. It is to be noted that these numerical values are stored on the membership management server 13 so as to be associated with an identification code of the membership card.

Here, the IC card is, for example, a non-contact IC card and has incorporated thereon an IC (Integrated Circuit) for recording and computing a variety of pieces of data such as credits and enables short-range wireless communication using an RFID (Radio Frequency Identification) technology such as NFC (Near Field Communication), for example. By using the IC card 1500, a player can have the credit-related data and further, can freely carry this with him or her among different slot machines. A player inserts the IC card 1500 into the PTS terminal 1700 of the slot machine 1010 and thereby uses the credit-related data (money amount data) stored on the IC card 1500, thereby allowing a player to play a game such as a unit game on the slot machine 1010.

It is to be noted that it may be made possible for a player to deposit cash such as coins and bills as cash data on the IC card 1500 by using an apparatus installed in a hall.

In addition, below the lower image display panel 1141, the PTS terminal 1700 is incorporated into the cabinet 1011. Further, on right and left sides besides the PTS terminal 1700, speakers 1112 are provided, respectively. On an upper portion of the top box 1012, a lamp 1111 is provided. On the slot machine 1010, presentation in a unit game is executed through displaying of images by the upper image display panel 1131, outputting of sound by the speakers 1112, outputting of light by the lamp 1111, and the like.

[Configuration of PTS Terminal]

Figure 5:
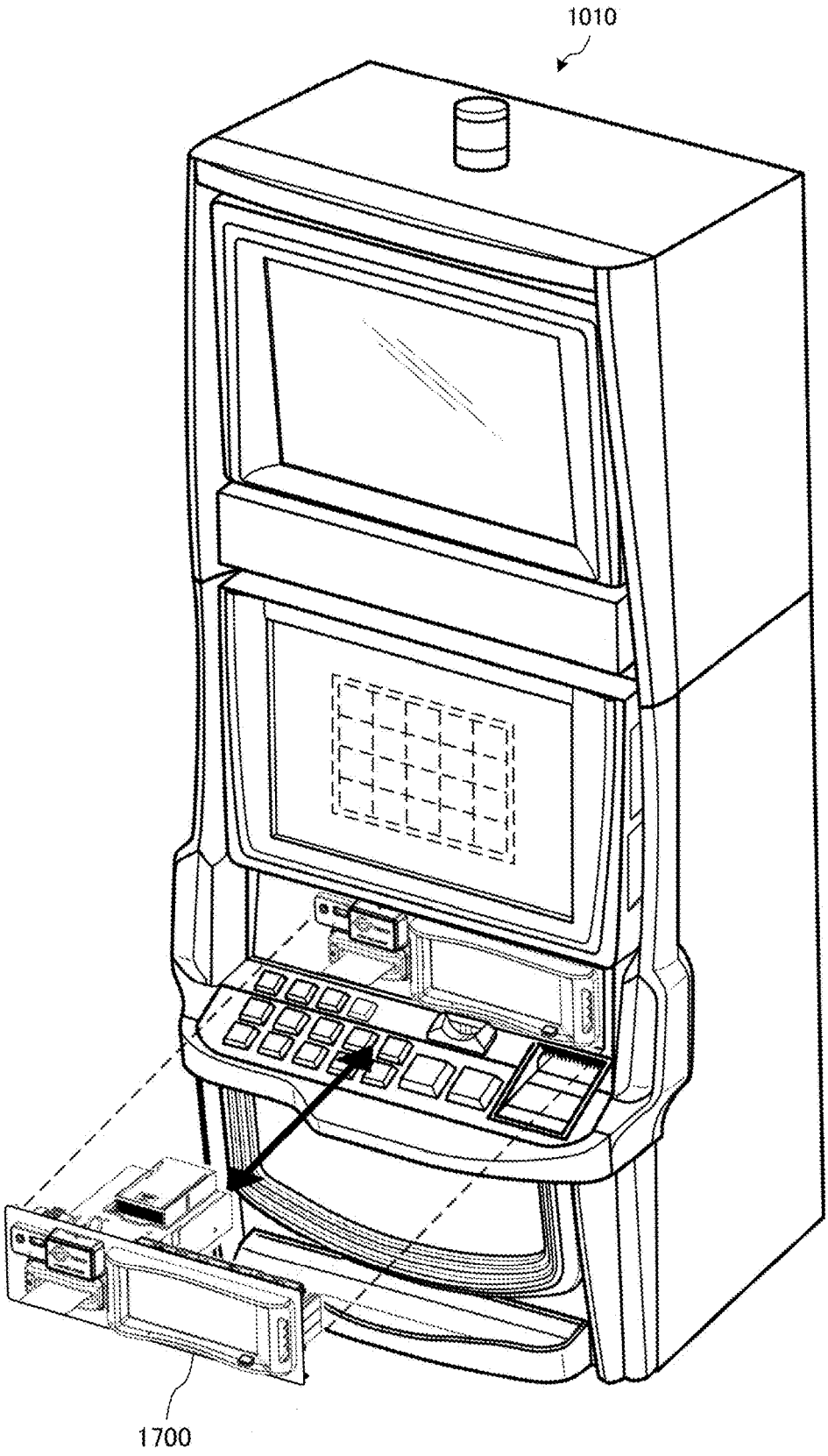
FIG. 5 is a view illustrating a PTS terminal which is incorporated into the slot machine according to the one embodiment of the present invention.

FIG. 5 is a diagram illustrating a PTS terminal 1700 incorporated into a slot machine 1010. The PTS terminal 1700 uses a data interface which is commonalized for gaming machines to communicate data and can be thereby incorporated into a variety of types of gaming machines manufactured by a variety of makers.

Figure 6:
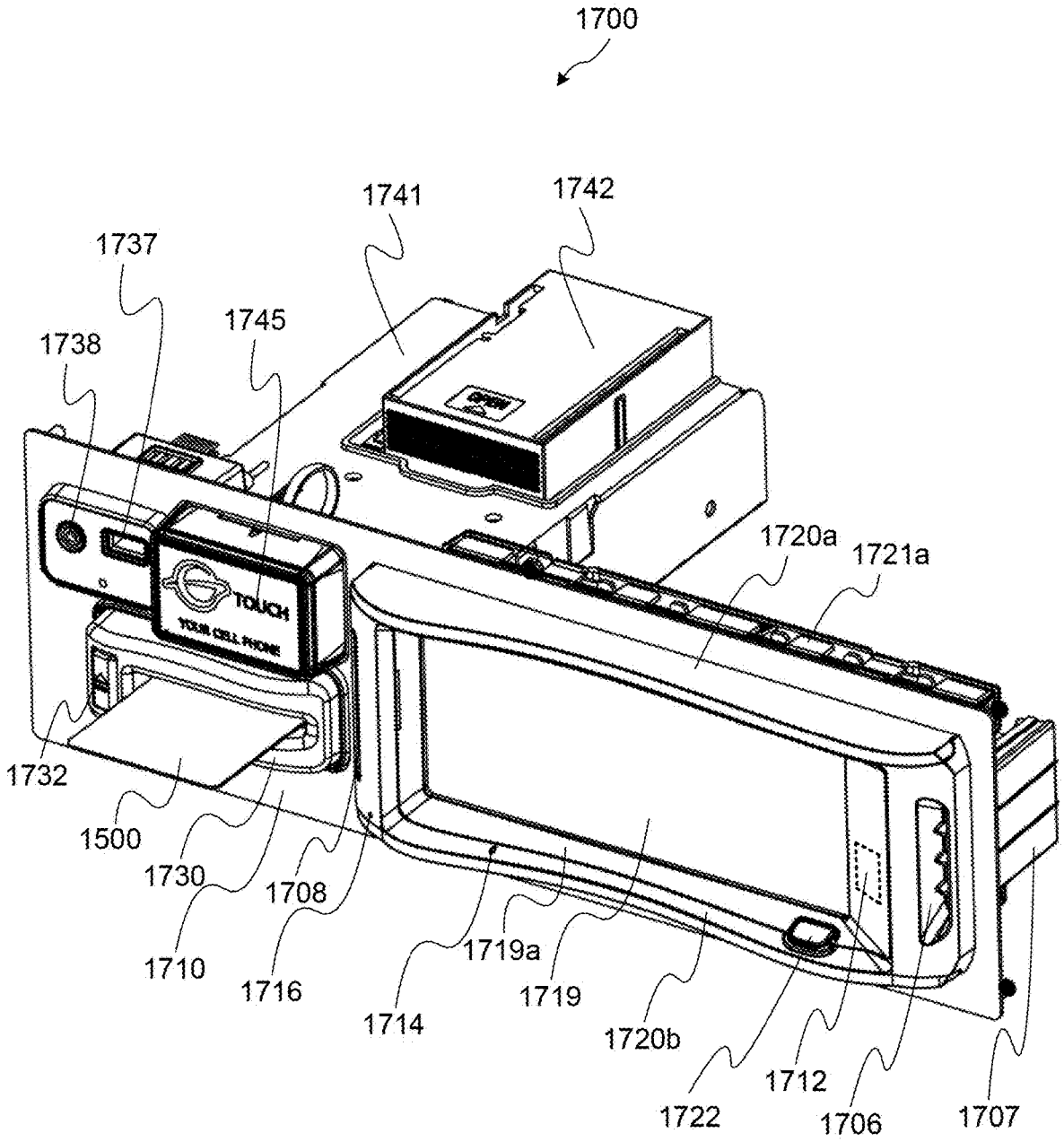
FIG. 6 is a view illustrating the PTS terminal according to the one embodiment of the present invention in an enlarged manner.

FIG. 6 is an enlarged view of the PTS terminal 1700 shown in FIG. 5. As shown in FIG. 6, the PTS terminal 1700 has a panel 1710, respective parts located on a front face of the panel 1710 are viewable by a player, and members located on a rear face of the panel 1710 are housed inside of the cabinet 1011 of the slot machine 1010 and are not viewable by a player.

On a right side of the front face of the panel 1710, an LCD 1719 having a touch panel function is provided. The LCD 1719 displays, for example, information related to members and information for members, and a size of a screen thereof is 6.2 inches (approximately 15.7 cm). In addition, around the LCD 1719, an LCD cover 1719*a* is provided. It is to be noted that although in this example, the LCD 1719 is configured to have the touch panel function, instructions issued by a player may be inputted with other input devices such as a keyboard and a mouse.

In addition, above the LCD 1719 and the LCD cover 1719*a*, a light emitting plate 1720*a* which is connected to LEDs and emits light is provided. The light emitting plate 1720*a* is formed of, for example, polycarbonate and is connected to a plurality of (for example, seven) full-color LEDs 1721*a* located on a rear side of the panel 1710 and emits light in accordance with light emitting of the full-color LEDs 1721*a*.

Below the LCD 1719 and the LCD cover 1719*a*, similarly, a light emitting plate 170*b* which is connected to LEDs and emits light is provided. The light emitting plate 170*b* is formed of, for example, polycarbonate and is connected to a plurality of (for example, seven) full-color LEDs 1721*b* (not shown) located on the rear side of the panel 1710 and emits light in accordance with light emitting of the full-color LEDs 1721*b*.

In addition, on a right side of the LCD 1719, an image pickup window 1712 is provided, and a human body detection camera 1713 (not shown) located inside of the LCD cover 1719*a* or on the rear side of the panel 1710 shoots an image of a player via this image pickup window 1712. The image pickup window 1712 may be also formed of, for example, a half mirror material which has undergone shield processing such as smoke processing.

In addition, at a position of the LCD cover 1719*a*, which is below the LCD 1719 and is on a right side, a home button 1722 is provided. The home button 1722 is a button to shift a screen displayed on the LCD 1719 to a predetermined upper level screen.

Further, at a position of the LCD cover 1719*a*, which is on the right side of the LCD 1719, a speaker duct 1706 is provided, and in a position on the rear side of the panel 1710, which corresponds to a position of the speaker duct 1706, a bass reflex type speaker 1707 is provided. Similarly, on a left side of the LCD 1719, a speaker duct 1708 is provided, and in a position on the rear side of the panel 1710, which corresponds to a position of the speaker duct 1708, a bass reflex type speaker 1709 (not shown) is provided. These speakers are speakers dedicated to the PTS terminal 1700 and are provided separately from the speakers 1112 for a slot machine game provided on the slot machine 1010. These speakers are capable of realizing linkage presentation and a phone call by voice and of outputting notification sound for notifying a player that an IC card 1500 is left unremoved. It is to be noted that since the configuration thereof is made such that sound from the speakers passes through the above-described speaker ducts 1706 and 1708 and is heard in front thereof (on a player side) in a stereophonic manner, the speakers can be installed on the rear side of the panel 1710 and as a result, space-saving of the PTS 1700 (panel face) can be realized.

In addition, at positions of the LCD cover 1719*a*, which are below the LCD 1719 and are on a left side, a microphone opening 1714 and a microphone opening 1716 are provided. In portions corresponding to the microphone opening 1714 and the microphone opening 1716 inside of the LCD cover 1719*a*, microphones 1715 and 1717 (not shown) are provided, respectively.

In a left lower portion of the front face of the panel 1710, a card insertion slot 1730 which allows an IC card 1500 to be inserted thereto and removed therefrom is provided. In a card insertion part of the card insertion slot 1730, full-color LEDs 1731 (not shown) are provided, which are lit up in a plurality of colors, thereby allowing the remaining number of IC cards 1500 stacked in the later-described card stacker 1742 to be notified. At the card insertion slot 1730, an eject button 1732 is provided, and in the vicinity of the eject button 1732, an LED 1733 (not shown) is provided, which is lit up in red, thereby allowing a position and a way of an ejection operation of the eject button 1732 to be found.

In addition, in positions on a rear side of the panel 1710, which correspond to the card insertion slot 1730, a card unit 1741 and the card stacker 1742 are provided, and the card insertion slot 1730 is configured as one part of the card unit 1741. In the card stacker 1742, approximately 30 IC cards 1500 can be retained, and when a player who has newly played a unit game makes settlement of credits, an IC card 1500 retained in the card stacker 1742 is taken out and ejected to the card insertion slot 1730.

For the IC card 1500 taken in from the card insertion slot 1730 and retained in the card unit 1741, upon the settlement of credits, credit information is updated by NFC or the like, and thereafter, the IC card 1500 is ejected from the card insertion slot 1730. While a player is playing a unit game, the IC card 1500 is completely housed inside of the card unit 1741.

In addition, in a case where upon the settlement of credits, in spite of the IC card 1500 left unremoved, absence of a player is detected by the human body detection camera or the like, the configuration may also be arranged such that the IC card 1500 can be retained in the card stacker 1742. Thus, for example, even in a case where a player has learned that the remaining number of credits is small and yet has left his or her seat with the IC card 1500 left unremoved or in a case where a player has simply forgotten to remove the IC card 1500 and has left his or her seat, it does not occur that the IC card 1500 is left retained in the card unit 1741 over a long period of time.

In positions on a left upper side of the front face of the panel 1710, a USB terminal 1737 and an audio terminal 1738 are provided. The USB terminal 1737 is configured to allow battery charge or the like by connecting a USB device thereto. In addition, the audio terminal 1738 is, for example, a four-pole terminal, and a headset is inserted thereto, thereby allowing a phone call with other person to be made with the headphones and the microphones. In addition, the audio terminal 1738 may be configured to be a two-pole or three-pole terminal, thereby allowing sound to be listened with the headphones.

On the front face of the panel 1710 and on the left side of the LCD 1719, a touch unit 1745 is provided. The touch unit 1745 includes an RFID module which can function as a writer to write data through data communication to an IC device including an IC chip (for example, a non-contact IC card, a mobile phone and a smartphone, each of which has a communication function by NFC, and the like) and which can function as a reader to read data through the data communication from said IC device. In addition, in four corners of the front face of the touch unit 1745, LEDs 1746 (not shown) are located, respectively. In addition, besides the touch unit 1745 or instead of the touch unit 1745, an information recording medium reading device for reading information stored in an information recording medium such as a magnetic card may be provided. In this case, instead of the IC card 1500, the magnetic card may be a membership card.

As described above, the PTS terminal 1700 according to the one embodiment of the present invention is formed such that the variety of devices having the microphone function, the camera function, the speaker function, the display function, and the like are integrated into one unit, thus realizing space-saving. This allows avoiding of inconvenience, for example, in that by mounting respectively single parts having the above-mentioned functions, if the LCD is mounted so as to face a player, the speakers cannot be mounted so as to face a player.

[Advantage of Mounting Both of Card Unit and Touch Unit]

In addition, the PTS terminal 1700 according to the one embodiment of the present invention is configured such that upon inserting an IC card 1500 into a card insertion slot 1730, contents of the IC card 1500 is read by a card unit 1741, and the whole IC card 1500 is taken in (inside of the PTS terminal 1700) and is held thereinside. In addition thereto, a touch unit 1745 is provided and this allows data communication with another IC card, a mobile phone, and a smartphone.

By employing the above-described configuration of the PTS terminal 1700 according to the present invention, for example, in a case where while a player who is a member is playing a game on a gaming machine (at this time, a membership card is held in the card unit 1741), when some maintenance comes to be required, a staff member touches an IC card for maintenance onto this touch unit 1745, thereby enabling a screen for the maintenance to be displayed on an LCD 1719 of the PTS terminal 1700 and contents and a history of the maintenance to be transmitted to a server and stored thereon.

In addition, for example, in a case where maintenance for a plurality of gaming machines is simultaneously conducted or maintenance for a large number of gaming machines is continuously conducted, a staff member consecutively touches the card for maintenance onto these touch units 1745, thereby allowing operations of displaying the screen for maintenance, registering of contents of maintenance, and the like to be quickly performed.

On the other hand, if the PTS terminal 1700 is configured such that only the touch unit 1745 enables access to an IC card or the like, when after a player playing a game by initially touching an IC card 1500 thereonto has left a gaming machine, another player uses that gaming machine, the gaming machine cannot recognize switching of a player. Also in order to solve such inconvenience, the card unit 1741 which holds the IC card 1500 during a game is required. For example, if after a player playing a game by initially touching an IC card 1500 thereonto has left a gaming machine, another player plays a game on that gaming machine by inputting bills (without using any IC card) and makes settlement, credit-related data is stored on the IC card 1500 of the initial player.

[Configuration of Circuitry Included in Slot Machine]

Figure 7:
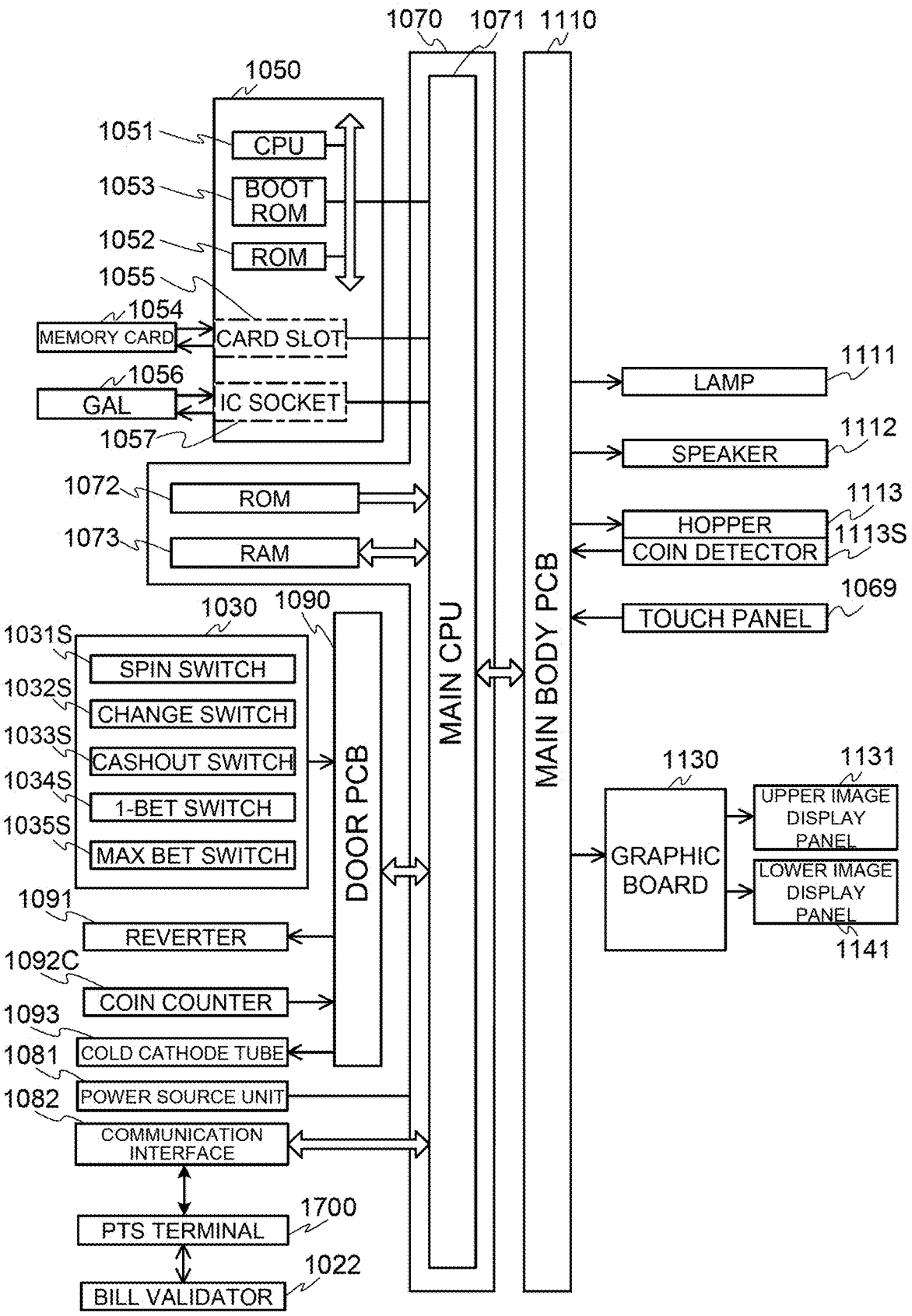
FIG. 7 is a diagram showing a circuitry configuration of the slot machine according to the one embodiment of the present invention.

Next, with reference to FIG. 7, a configuration of circuitry included in a slot machine 1010 will be described.

A gaming board 1050 is provided with: a CPU 1051, a ROM 1052, and a boot ROM 1053, which are mutually connected by an internal bus; a card slot 1055 corresponding to a memory card 1054; and an IC socket 1057 corresponding to a GAL (Generic Array Logic) 1056.

The memory card 1054 includes a non-volatile memory and stores a game program and a game system program. The game program includes a program related to game progression and a program for producing presentation by images and sounds. In addition, the above-mentioned game program includes a symbol determination program. The symbol determination program is a program for determining symbols to be rearranged in display blocks 1028.

In addition, the card slot 1055 is configured such that the memory card 1054 can be inserted thereinto and removed therefrom and is connected to a motherboard 1070 by an IDE bus. Accordingly, the memory card 1054 is pulled out from the card slot 1055, another game program is written into the memory card 1054, and that memory card 1054 is inserted into the card slot 1055, thereby allowing a kind and contents of a game played on the slot machine 1010 to be changed.

The GAL 1056 is a type of a PLD (Programmable Logic Device) having a fixed OR array structure. The GAL 1056 is provided with a plurality of input ports and output ports, and predetermined input into the input port causes output of the corresponding data from the output port.

In addition, the IC socket 1057 is configured such that the GAL 1056 can be inserted thereinto and removed therefrom and is connected to the motherboard 1070 by a PCI bus. The contents of the game to be played on the slot machine 1010 can be changed by replacing the memory card 1054 with another memory card 1054 having another program written therein or by rewriting the program written into the memory card 1054 as another program.

The CPU 1051, the ROM 1052, and the boot ROM 1053 mutually connected by the internal bus are connected to the motherboard 1070 by a PCI bus. The PCI bus enables a signal transmission between the motherboard 1070 and the gaming board 1050 and power supply from the motherboard 1070 to the gaming board 1050.

The ROM 1052 stores an authentication program. The boot ROM 1053 stores a pre-authentication program, a program (boot code) to be used by the CPU 1051 for activating the pre-authentication program, and the like.

The authentication program is a program (tamper check program) for authenticating the game program and the game system program. The pre-authentication program is a program for authenticating the above-mentioned authentication program. The authentication program and the pre-authentication program are written along a procedure (authentication procedure) for proving that the program to be the subject has not been tampered.

The mother board 1070 is configured by using a commercially available general-purpose mother board (printed circuit board having basic components of a personal computer mounted thereon) and includes a main CPU 1071, a ROM (Read Only Memory) 1072, a RAM (Random Access Memory) 1073, and a communication interface 1082. It is to be noted that the main CPU 1071 corresponds to a controller 1100 of the slot machine 1010.

The ROM 1072 includes a memory device such as a flash memory and stores a program such as BIOS (Basic Input/Output System) to be executed by the main CPU 1071 and permanent data. When the BIOS is executed by the main CPU 1071, processing for initializing predetermined peripheral devices is conducted; and further, through the gaming board 1050, processing of loading the game program and the game system program stored in the memory card 1054 is started. It is to be noted that in the present invention, the ROM 1072 may be a ROM in which contents are rewritable or a ROM in which contents are un-rewritable.

The RAM 1073 stores data and programs such as the symbol determination program which are used in operation of the main CPU 1071. For example, when the processing of loading the above-mentioned game program, game system program, or authentication program is conducted, the RAM 1073 can store the program. The RAM 1073 is provided with working areas used for operations in execution of these programs. Examples of the areas include: an area that stores counters for managing the number of games, the number of BETs, the number of payout, the number of credits, and the like; and an area that stores symbols (code numbers) determined by a drawing.

The communication interface 1082 is to control transmission and reception of data with the PTS terminal 1700. In addition, the motherboard 1070 is connected with the later-described door PCB (Printed Circuit Board) 1090 and a main body PCB 1110 by respective USBs. The motherboard 1070 is also connected with a power supply unit 1081.

When power is supplied from the power supply unit 1081 to the motherboard 1070, the main CPU 1071 of the motherboard 1070 is activated, and then the power is supplied to the gaming board 1050 through the PCI bus so as to activate the CPU 1051.

The door PCB 1090 and the main PCB 1110 are connected with input devices such as switches and sensors and peripheral devices, the operations of which are controlled by the main CPU 1071.

The door PCB 1090 is connected with a control panel 1030, a reverter 1091, a coin counter 1092C, and a cold cathode tube 1093.

The control panel 1030 is provided with a spin switch 1031S, a change switch 1032S, a CASHOUT switch 1033S, a 1-BET switch 1034S, and a MAX-BET switch 1035S which correspond to the above-mentioned respective buttons. Each of the switches outputs a signal to the main CPU 1071 upon detection of pressing of the button corresponding thereto by a player.

Inside of a coin entry 1036, the reverter 1091 and the coin counter 1092C are provided. The reverter 1091 identifies whether or not coins inputted into the coin entry 1036 are authentic and discharges coins other than authentic coins from a coin payout outlet. In addition, the reverter 1091 detects authentic coins accepted by the coin counter 1092C and counts a number of the accepted authentic coins.

The reverter 1091 operates based on a control signal outputted from the main CPU 1071 and distributes authentic coins validated by the coin counter 1092C into a hopper 1113 or a cash box (not shown). That is, coins are distributed into the hopper 1113 when the hopper 1113 is not filled with coins, while coins are distributed into the cash box when the hopper 1113 is filled with coins.

The cold cathode tube 1093 functions as a backlight installed on the rear face sides of the upper image display panel 1131 and the lower image display panel 1141 and lights up based on a control signal outputted from the main CPU 1071.

The main body PCB 1110 is connected with the lamp 1111, the speaker 1112, the hopper 1113, a coin detecting part 1113S, a touch panel 1069, and a graphic board 1130. It is to be noted that although in this example, the bill validator 1022 is connected to the PTS terminal 1700, the bill validator 1022 may be configured to be connected to the slot machine 1010.

The lamp 1111 lights up based on a control signal outputted from the main CPU 1071. The speaker 1112 outputs sound such as BGM based on a control signal outputted from the main CPU 1071.

The hopper 1113 operates based on a control signal outputted from the main CPU 1071 and pays out the specified number of coins from the coin payout outlet to a coin tray 1018. The coin detecting part 1113S outputs a signal to the main CPU 1071 upon detection of coins paid out by the hopper 1113.

The touch panel 1069 detects a position on the lower image display panel 1141 touched by a player's finger or the like and outputs to the main CPU 1071 a signal corresponding to the detected position.

The bill validator 1022 identifies whether or not bills are authentic and accepts authentic bills into the cabinet 1011. An amount of the bills inputted into the cabinet 1011 is converted to a number of coins and a credit which is equivalent to the converted number of coins is added as a credit which a player has.

The graphic board 1130 controls display of images conducted by each of the respective upper image display panel 1131 and lower image display panel 1141 based on a control signal outputted from the main CPU 1071. The graphic board 1130 is provided with a VDP (Video Display Processor) generating image data, a video RAM storing the image data generated by the VDP, and the like. It is to be noted that the image data used in generation of image data by the VDP is included in the game program which has been read from the memory card 1054 and stored into the RAM 1073.

In addition, the graphic board 1130 is provided with the VDP (Video Display Processor) generating image data based on a control signal outputted from the main CPU 1071, the video RAM temporarily storing the image data generated by the VDP, and the like. It is to be noted that the image data used in generation of image data by the VDP is included in the game program that has been read from the memory card 1054 and stored into the RAM 1073.

[Circuitry Configuration of PTS Terminal]

Figure 8:
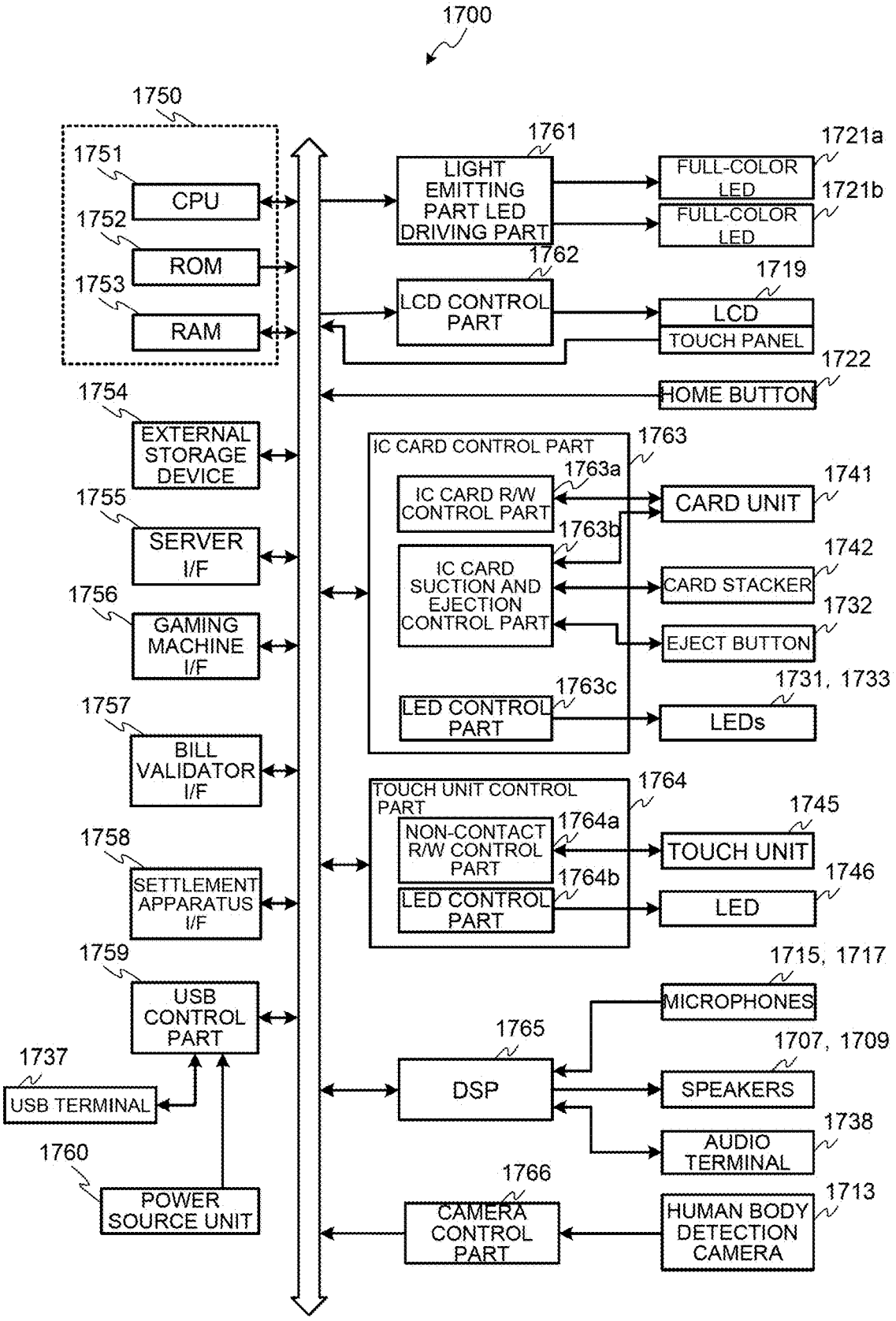
FIG. 8 is a diagram showing a circuitry configuration of the PTS terminal according to the one embodiment of the present invention.

Next, with reference to FIG. 8, a configuration of circuitry which a PTS terminal 1700 includes will be described.

A PTS controller 1750 for controlling the PTS terminal 1700 has a CPU 1751, a ROM 1752, and a RAM 1753.

The CPU 1751 controls execution of each component of the PTS terminal 1700, executes a variety of programs stored in the ROM 1752, and performs computation. For example, the CPU 1751 executes a credit updating program and updates credit-related data stored in an IC card 1500.

The ROM 1752 is constituted of a memory device such as a flash memory and has stored therein permanent data executed by the CPU 1751. For example, in the ROM 1752, a credit updating program for rewriting credit-related data stored in the IC card 1500, a linkage presentation control program executed in response to a request from a bonus server 11, and the like can be stored.

The RAM 1753 temporarily stores data required upon executing the variety of programs stored in the ROM 1752.

An external storage device 1754 is, for example, a storage device such as a hard disk device and stores the programs executed by the CPU 1751 and data which the programs executed by the CPU 1751 use.

A server I/F (interface) 1755 realizes data communication between servers such as a hall management server 10, the bonus server 11, and the like and the PTS terminal 1700. A gaming machine I/F (interface) 1756 realizes data communication between a controller 1100 of a slot machine 1010 and the PTS terminal 1700, and for said data communication, a prescribed protocol can be used.

Besides, the PTS terminal 1700 is connected to a bill validator 1022 via a bill validator I/F (interface) 1757 and connected to a settlement apparatus 1868 via a settlement apparatus I/F (interface) 1758 and is operable to perform transmission and reception of data as needed.

A USB control part 1759 determines whether on a USB terminal 1737, power is supplied from a power supply unit 1760 and when a predetermined condition is satisfied, enables the recharging on the USB terminal 1737. When the predetermined condition is satisfied, a player connects an electronic device to the USB terminal 1737, thereby allowing said electronic device to be recharged.

A light emitting part LED driving part 1761, in response to a linkage presentation start request from the bonus server 11, performs control such that in order to cause an upper light emitting plate 1720*a* of an LCD 1719 to emit light, full-color LEDs 1721*a* are lit up at predetermined timing and performs control such that in order to cause a lower light emitting plate 170*b* of the LCD 1719 to emit light, full-color LEDs 1721*b* are lit up at predetermined timing.

An LCD control part 1762 performs control to cause the LCD 1719 to display information pertinent to members, information for the members, and the like and to display data read out from an IC card 1500 and data inputted by a player. In addition, the LCD 1719 has a touch panel function and when a touch panel is operated by a player, a predetermined signal is transmitted to the CPU 1751.

A home button 1722 is provided in the vicinity of the LCD 1719 and is a button for shifting a screen displayed on the LCD 1719 to a predetermined upper level screen. When the home button 1722 is pressed by a player, that operation by a player is transmitted to the CPU 1751, and the CPU 1751 transmits an instruction to the LCD control part 1762 to update the display on the LCD 1719 in accordance with said operation.

An IC card control part 1763 performs control for insertion and ejection of an IC card 1500, writing of credit data thereto, and the like. The IC card control part 1763 includes an IC card R/W (reader/writer) control part 1763*a*, an IC card suction and ejection control part 1763*b*, and an LED control part 1763*c*.

The IC card R/W control part 1763*a* controls a card unit 1741 to update credit-related data stored in an IC card 1500. In addition, when an IC card 1500 is newly issued, credit-related data corresponding a settled money amount is stored therein. The card unit 1741 has an antenna part for reading or writing data by NFC or the like from or to an IC card 1500.

Although the card unit 1741 has functions of an IC card reader for reading information stored in an IC card 1500 and an IC card writer for writing information to an IC card 1500, the card unit 1741 may have a function of either one of the IC card reader and the IC card writer as needed.

The IC card suction and ejection control part 1763*b* performs control for suction and ejection of an IC card 1500. When an IC card 1500 is inserted by a player into a card insertion slot 1730, the IC card suction and ejection control part 1763*b* performs control to retain the IC card while a player is executing a game. In addition, after the credit-related data has been written in the IC card 1500 upon the settlement, the IC card suction and ejection control part 1763*b* performs control to eject that IC card 1500. Further, when an eject button 1732 has been pressed, the IC card suction and ejection control part 1763*b* ejects the IC card 1500.

In addition, when an IC card 1500 is newly issued, the IC card suction and ejection control part 1763*b* newly takes out an IC card 1500 from a card stacker 1742 and in order to cause the IC card 1500 to store credit-related data, supplies the IC card 1500 to the card unit 1741.

The LED control part 1763*c* performs control to light up LEDs (full-color LEDs 1731) provided in the vicinity of the card insertion slot 1730 of the card unit 1741 and to light up an LED (red LED 1733) provided in the vicinity of the eject button 1732.

A touch unit control part 1764 controls data transmission and reception associated with a touch operation by an IC card 1500, a mobile phone, a smartphone, or the like. The touch unit control part 1764 includes a non-contact R/W (reader/writer) control part 1764*a* and an LED control part 1764*b*.

The non-contact R/W control part 1764*a* determines whether or not an IC card 1500 or a mobile phone comes within a predetermined distance close to a touch unit 1745 (for example, a touch operation has been conducted thereon) and when the IC card 1500 or the mobile phone has come within the predetermined distance close thereto, the non-contact R/W control part 1764*a* obtains a reading-out result from the touch unit 1745. The touch unit 1745 has an antenna part for performing data transmission and reception to and from the IC card 1500 or the mobile phone by the NFC or the like.

Although the touch unit 1745 has functions of an IC card reader for reading information stored in an IC card 1500 or a mobile phone and an IC card writer for writing information to the IC card 1500 or the mobile phone, the touch unit 1745 may have a function of either one thereof as needed.

The LED control part 1764*b* controls LEDs 1746 located in four corners of a front face of the touch unit 1745 to light up the LEDs 1746 at predetermined timing.

A DSP 1765 receives sound data obtained from microphones 1715 and 1717 and subjects the sound data to predetermined processing and thereafter, transmits the processed data to the CPU 1751. In addition, the DSP 1765 transmits the received sound data to speakers 1707 and 1709. Further, the DSP 1765 outputs, to an audio terminal connected with a headset, the received sound to headphones and processes the sound received from the microphones and transmits the processed sound to the CPU 1751. It is to be noted that here, the configuration of the outline is described and the description on an A/D converter, a D/A converter, an amplifier, and the like is omitted.

A camera control part 1766 obtains an image of a player or the like shot by a human body detection camera 1713, subjects the image to predetermined image processing as needed, and transmit the processed data to the CPU 1751. Said data is transmitted, for example, via the server I/F 1755 to the hall management server 10, a membership management server 13, and the like.

[Configuration of Symbol Combination Table]

Next, with reference to FIG. 9, a symbol combination table will be described.

The symbol combination table specifies combinations of drawn symbols related to winning and the numbers of payout. On the slot machine 1010, the scrolling of symbol arrays of five pseudo reels 1151 to 1155 (a first video reel to a fifth video reel) is stopped, and winning is established when the combination of symbols displayed along a winning line matches one of the combinations of symbols specified by the symbol combination table. According to the winning combination, a benefit such as payout of coins is awarded to a player. It is to be noted that winning is not established (i.e.

the game is lost) when the combination of symbols displayed along the winning line does not match any of the combinations of symbols specified by the symbol combination table.

Basically, winning is established when all symbols displayed along the winning line by all of the five pseudo reels 1151 to 1155 are of one kind out of kinds of symbols "RED", "APPLE", "BLUE 7", "BELL", "CHERRY", "STRAWBERRY", "PLUM", and "ORANGE". However, with respect to the respective kinds of symbols "CHERRY" and "ORANGE", winning is also established when one or three symbols of either kind are displayed along the winning line by the pseudo reel or the pseudo reels.

For example, when all the symbols displayed along the winning line by all of the five pseudo reels 1151 to 1155 are the symbols "BLUE 7", the winning combination is a "BLUE" combination, and "10" is determined as the number of payout. Based on the determined number of payout, the payout of coins is conducted. The payout of coins is conducted, for example, such that the added credit is stored in the IC card 1500 and thereafter, the IC card 1500 is ejected from the card insertion slot 1730.

[Contents of Programs Executed on Slot Machine]

Next, with reference to FIG. 10 to FIG. 14, programs executed on a slot machine 1010 will be described.

<Main Control Process>

Figure 10:
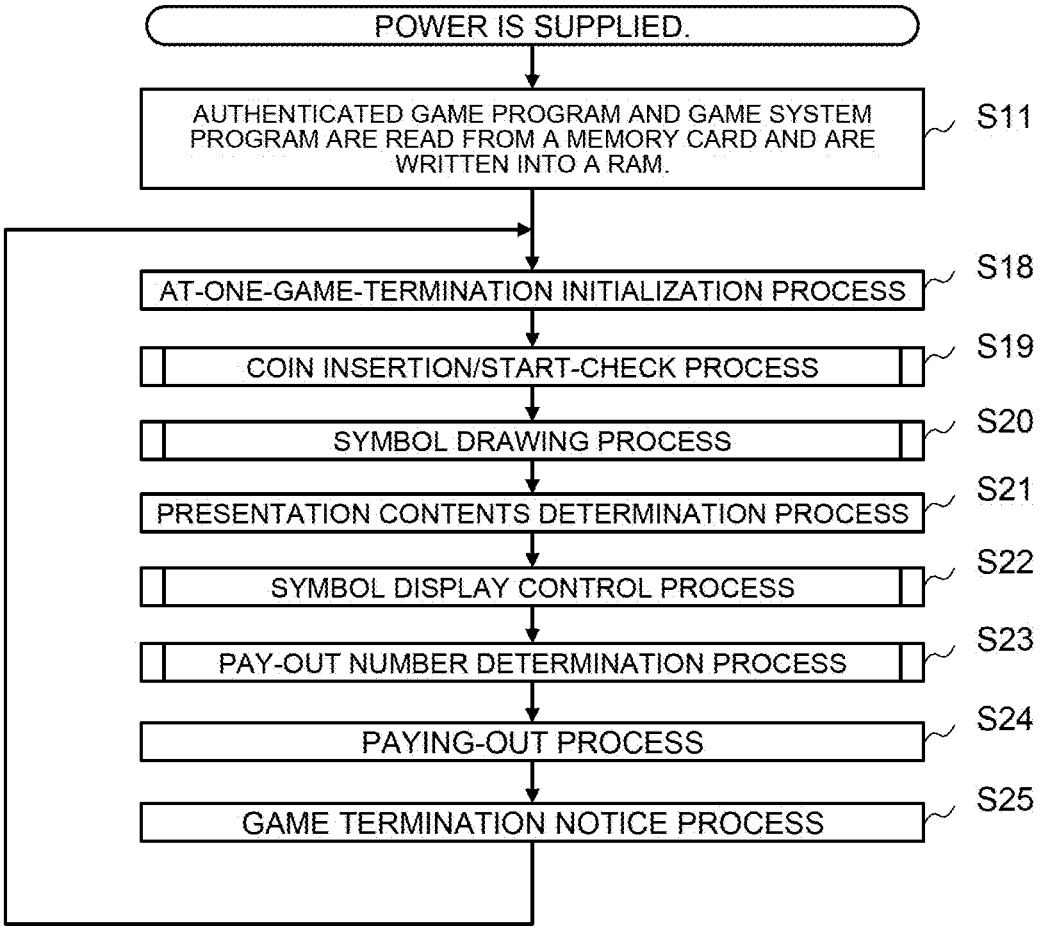
FIG. 10 is a flowchart showing a procedure of a main control process executed on the slot machine according to the one embodiment of the present invention.

First, with reference to FIG. 10, a main control process will be described. First, when power is supplied to the slot machine 1010, a main CPU 1071 reads the authenticated game program and game system program from a memory card 1054 via a gaming board 1050 and writes the programs into a RAM 1073 (step (hereinafter, abbreviated to S) 11).

Next, the main CPU 1071 conducts an at-one-game-termination initialization process (S18). For example, data that becomes unnecessary after each game in working areas of the RAM 1073, such as the number of BETs and the symbols determined by a drawing, is cleared.

Next, the main CPU 1071 conducts a coin insertion/start-check process which is described later (S19). In this process, input from a BET switch and a spin switch is checked.

Next, the main CPU 1071 conducts a symbol drawing process which is described later (S20). In this process, to-be stopped symbols are determined based on random number values for symbol determination.

Next, the main CPU 1071 conducts a presentation contents determination process (S21). The main CPU 1071 extracts a random number value for presentation and determines any of the presentation contents from a predetermined plurality of presentation contents by a drawing. The presentation contents can be determined in accordance with a winning combination and a state of a game on a slot machine 1010. For example, the configuration can be arranged such that in accordance with winning combinations and the states of the game on the slot machine 1010, drawing probabilities related to respective presentation contents are made different from one another.

Next, the main CPU 1071 conducts a symbol display control process which is described later (S22). In this process, the scrolling of five pseudo reels 1151 to 1155 (a first video reel to a fifth video reel) is started, and the to-be stopped symbols determined in the symbol drawing process at S20 are stopped in predetermined positions (for example, in a display window 1150 of a lower image display panel 1141). In other words, with respect to each of the reels, four symbols including each of the to-be stopped symbols are displayed in the display window 1150. For example, when a to-be-stopped symbol is a symbol associated with a code number "10" and it is to be displayed in an upper region, symbols associated with respective code numbers "11", "12", and "13" are to be displayed in an upper central region, a lower central region, and a lower region in the display window 1150, respectively.

Next, the main CPU 1071 conducts a to-be-paid-out number determination process which is described later (S23). In this process, based on a combination of symbols displayed on a winning line L, a to-be-paid-out number is determined and stored in a to-be-paid-out number counter provided in the RAM 1073.

Next, the main CPU 1071 conducts a paying-out process (S24). The main CPU 1071 adds the value stored in the to-be-paid-out number counter to a value stored in a number-of-credits counter provided in the RAM 1073. Here, for example, when a player presses a CASHOUT button, a CASHOUT switch 1033S which has detected the pressing thereof outputs a signal to the main CPU 1071, and a number of credits stored in an IC card 1500 held in a card unit 1741 is updated to a value in the number-of-credits counter.

In addition, driving of a hopper 1113 may be controlled based on input from the CASHOUT switch 1033S, and coins corresponding to the value stored in the to-be-paid-out number counter may be discharged to a coin tray 1018.

Next, the main CPU 1071 conducts a game termination notification process (S25). In this process, data indicating that one unit game has been terminated (together with an identification code or the like of an IC card 1500 in a case where an IC card 1500 or the like has been inserted and a player can be thereby identified) is transmitted to the PTS terminal 1700. The PTS terminal 1700 transmits this data to a hall management server 10, and in response thereto, a bonus server 11 conducts a drawing for a bonus game. After finishing the processing at S25, the main CPU 1071 returns to the processing at S18 and the unit game is repeated.

<Coin-Insertion/Start-Check Process>

Figure 11:
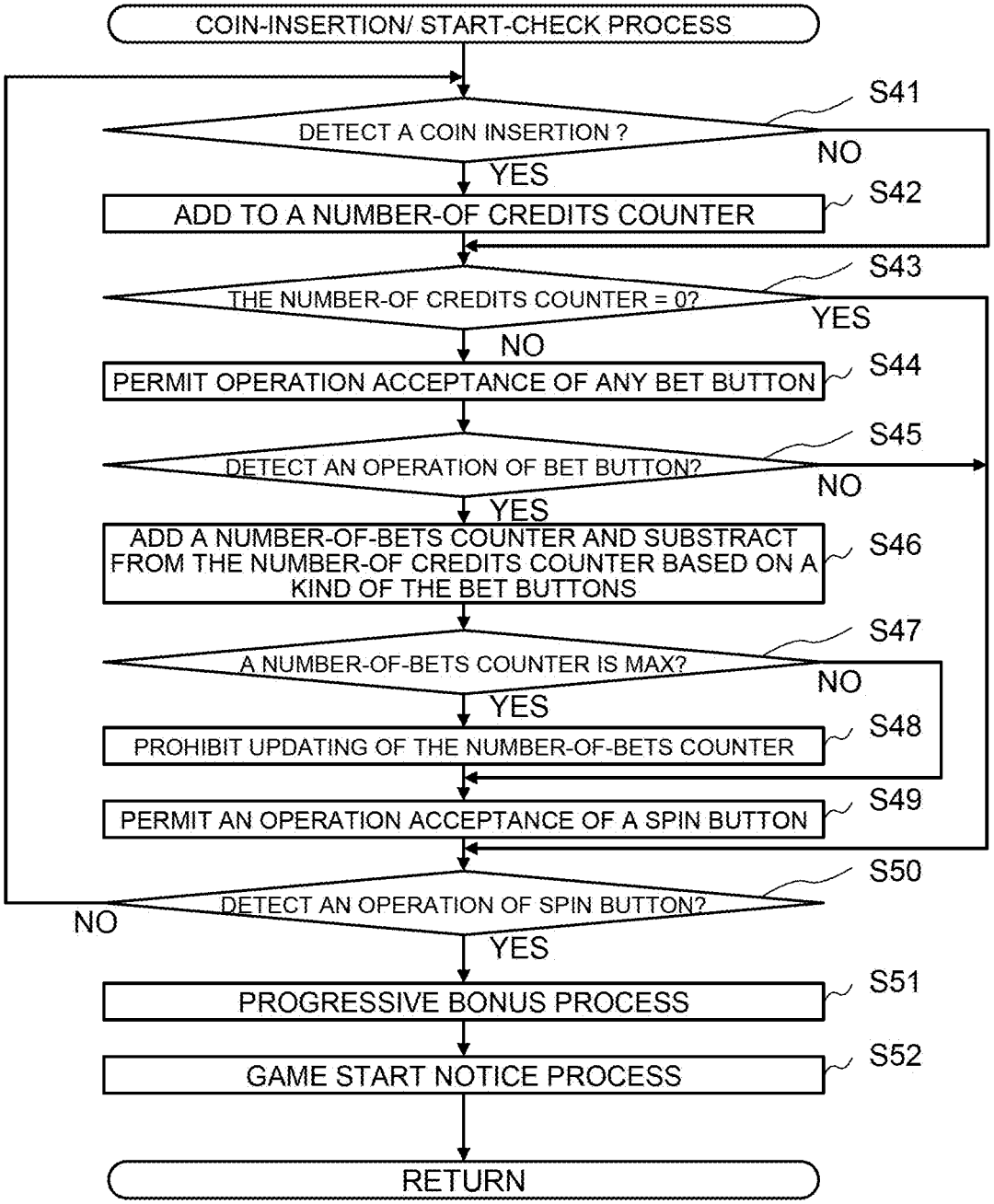
FIG. 11 is a flowchart showing a procedure of a coin-insertion/start-check process executed on the slot machine according to the one embodiment of the present invention.

Next, with reference to FIG. 11, a coin insertion/start-check process will be described. First, a main CPU 1071 determines whether or not insertion of a coin has been detected by a coin counter 1092C (S41). When determining that the insertion of a coin has been detected, the main CPU 71 makes an addition to a number-of-credits counter (S42). Furthermore, in addition to the insertion of a coin, the main CPU 71 determines whether or not insertion of a bill has been detected by a bill validator 1022, and when determining that the insertion of a bill has been detected, the main CPU 71 adds a value corresponding to the bill to the number-of-credits counter.

After the processing at S42 or when determining at S41 that the insertion of the coin or the like has not been detected, the main CPU 1071 determines whether or not a value stored in the number-of-credits counter is zero (S43). When the main CPU 71 determines that the value stored in the number-of-credits counter is not zero, the main CPU 71 permits operation acceptance of a BET button (S44).

Next, the main CPU 1071 determines whether or not operation of any of the BET buttons has been detected (S45). When the pressing of any BET button by a player has been detected by a BET switch, the main CPU 1071 performs addition to a number-of-BETs counter provided in the RAM 1073 and subtraction from the number-of-credits counter based on the kind of the BET button (S46).

Next, the main CPU 1071 determines whether or not a value stored in the number-of-BETs counter is at its maximum (S47). When the main CPU 1071 determines that the value stored in the number-of-BETs counter is at its maximum, the main CPU 1071 prohibits updating of the value stored in the number-of-BETs counter (S48). After S48 or when determining at S47 that the value stored in the number-of-BETs counter is not at its maximum, the main CPU 71 permits operation acceptance of a spin button (S49).

After S49 or when determining at S45 that the operation of any of the BET buttons has not been detected, or when determining at S43 that the value stored in the number-of-credits counter is zero, the main CPU 1071 determines whether or not operation of the spin button has been detected (S50). When the main CPU 1071 determines that the operation of the spin button has not been detected, the main CPU 1071 shifts the processing to S41.

When the main CPU 1071 determines that the operation of the spin button has been detected, the main CPU 1071 conducts a progressive bonus process. In this process, one part of the bet credit is paid out via a PTS terminal 1700 to a bonus server 11, for example, as a credit accumulated for a progressive bonus (S51).

Next, the main CPU 1071 conducts a game start notification process (S52). In this process, data indicating that one unit game is started (together with an identification code or the like of an IC card 1500 in a case where an IC card 1500 or the like has been inserted and a player can be thereby identified) is transmitted to the PTS terminal 1700. The PTS terminal 1700 transmits this data to a hall management server 10, and in response thereto, a bonus server 11 conducts a drawing for a bonus game. After the processing at S52 has been conducted, the coin insertion/start-check process is completed.

<Symbol Drawing Process>

Figure 12:
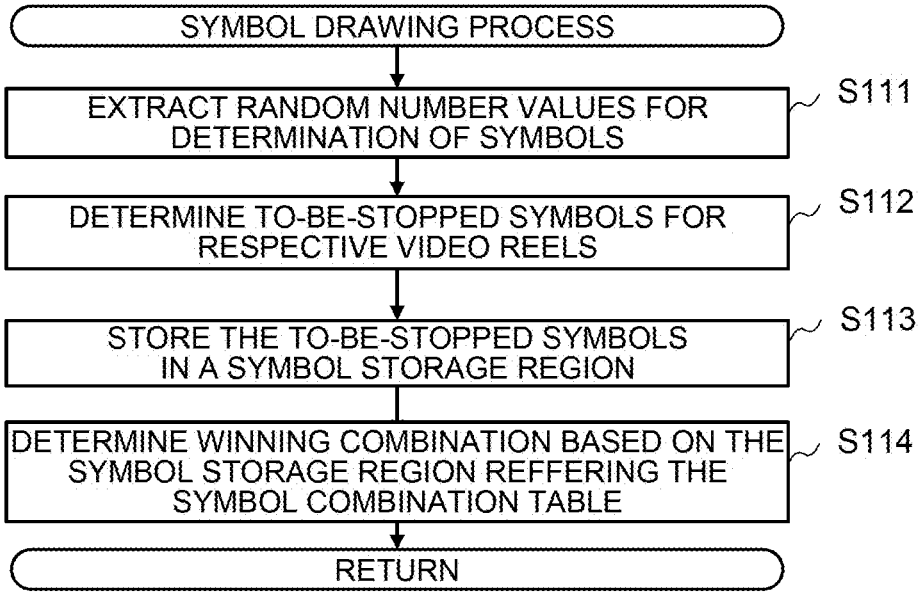
FIG. 12 is a flowchart showing a procedure of a symbol drawing process executed on the slot machine according to the one embodiment of the present invention.

Next, with reference to FIG. 12, a symbol drawing process will be described. First, the main CPU 1071 extracts random number values for symbol determination (S111). Next, the main CPU 1071 determines to-be stopped symbols for five pseudo reels 1151 to 1155 (a first video reel to a fifth video reel) by drawings (S112). The main CPU 1071 conducts a drawing for each of the video reels and determines any of 22 symbols (with code numbers "00" to "21") as to-be stopped symbols. At this time, each of the 22 symbols is determined at an equal probability (i.e. 1/22).

Next, the main CPU 1071 stores the determined to-be stopped symbols for the respective video reels in a symbol storage region provided in the RAM 1073 (S113). Next, the main CPU 1071 references a symbol combination table (FIG. 9) and determines a winning combination based on the symbol storage region (S114). The main CPU 1071 determines whether or not the combination of symbols to be displayed along a winning line by the respective video reels matches any of combinations of symbols specified by the symbol combination table and determines the winning combination. After the process has been conducted, the symbol drawing process is completed.

<Symbol Display Control Process>

Figure 13:
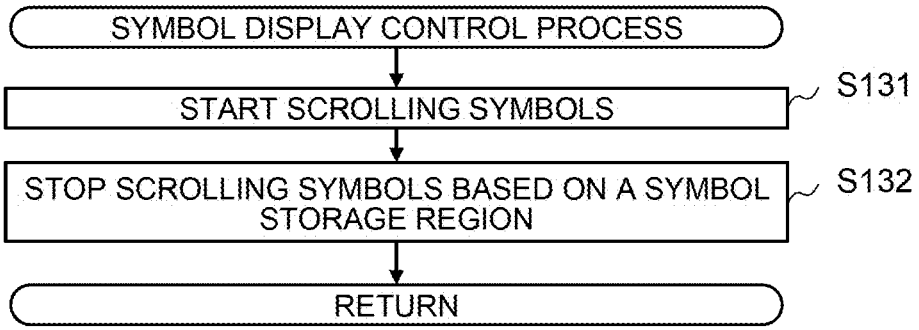
FIG. 13 is a flowchart showing a procedure of a symbol display control process executed on the slot machine according to the one embodiment of the present invention.

Next, with reference to FIG. 13, a symbol display control process will be described. First, a main CPU 1071 starts the scrolling of symbol arrays of respective video reels displayed in a display window 1150 of a lower image display panel 1141 (S131). Next, the main CPU 1071 stops the scrolling of the symbol arrays of the respective video reels based on the above-mentioned symbol storage region (S132). After the process has been conducted, the symbol display control process is completed.

It is to be noted that in accordance with timing of starting and stopping of the scrolling of the symbol arrays in the symbol display control process or other timing, the presentation determined in the presentation contents determination process (FIG. 10) is executed. For example, a moving image and a still image are displayed on an upper image display panel 1131 of the slot machine 1010, in synchronization therewith, sound is outputted from speakers 1112, and a lamp 1111 is lit up, thereby allowing said presentation to be executed.

<To-be-Paid-Out Number Determination Process>

Figure 14:
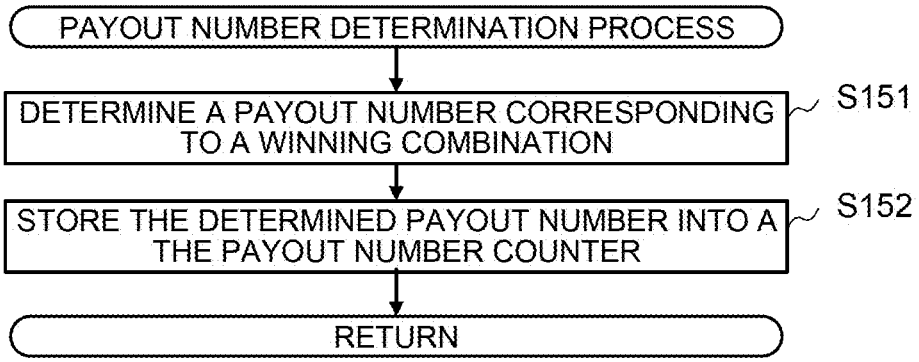
FIG. 14 is a flowchart showing a procedure of a to-be-paid-out number determination process executed on the slot machine according to the one embodiment of the present invention.

Next, with reference to FIG. 14, a to-be-paid-out number determination process will be described. First, a main CPU 1071 determines a to-be-paid-out number corresponding to a winning combination (S151). For example, when the winning combination is a combination of symbols "BELL", the main CPU 1071 determines "8" as the to-be-paid-out number (refer to FIG. 9). It is to be noted that the main CPU 1071 determines "0" as the to-be-paid-out number in a case where a game is lost. Next, the main CPU 1071 stores the determined to-be-paid-out number in a to-be-paid-out number counter (S152). After the process has been conducted, the to-be-paid-out number determination process is completed.

It is to be noted that winning has occurred in a bonus game drawing by a bonus server 11, linkage presentation by PTS terminals 1700 is conducted over a plurality of slot machines 1010 including the slot machine 1010 on which the winning has occurred; in conjunction therewith, a bonus is paid out by a bonus server 11; and the bonus is added to, for example, the to-be-paid-out number counter.

[Power Supply Control on USB Terminal]

Next, with reference to a flowchart shown in FIG. 15, a USB control process on a USB control part 1759 of a PTS terminal 1700 shown in FIG. 8 will be described.

The PTS terminal 1700 is provided with a USB terminal 1737 on a front face of a panel 1710. When a player connects an electronic device such as a mobile phone and a smartphone to the USB terminal (via a USB cable or the like), said device can be recharged under a predetermined condition.

Figure 15:
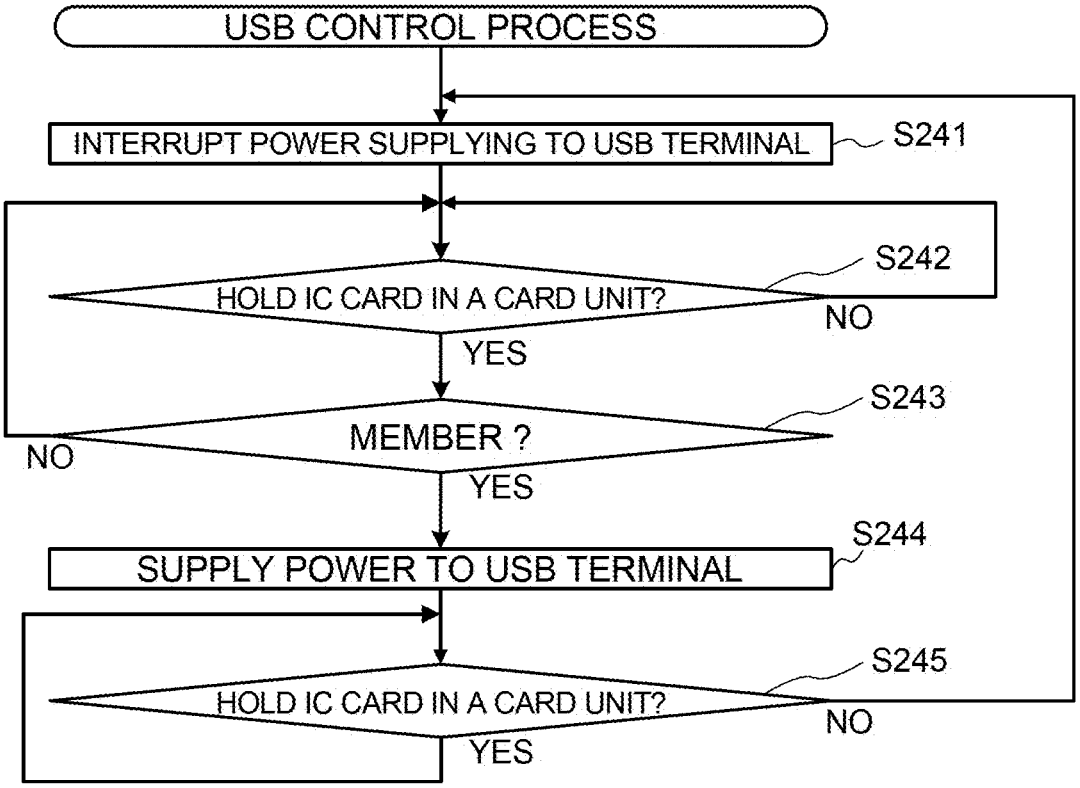
FIG. 15 is a flowchart showing a procedure of a USB control process on the PTS terminal according to the one embodiment of the present invention.

In the USB control process shown in FIG. 15, first, power is supplied to the PTS terminal 1700 and thereafter, power supply from a power supply unit 1760 to the USB terminal 1737 is interrupted (S241). In this state, even when the electronic device is connected to the USB terminal 1737, recharging is not made. It is to be noted that here, conducting data communication between the electronic device and the PTS terminal 1700 is permitted as needed.

Next, it is determined whether or not an IC card 1500 (that is, a membership card or an IC card of a non-member) is held by a card unit 1741 (S242). This is to determine whether or not a player has inserted an IC card into a card insertion slot 1730 and is playing a game.

When no IC card 1500 is held by the card unit 1741 (NO at S242), the processing is returned to S242 and this determination is repeated. When the IC card 1500 is held by the card unit 1741 (YES at S242), it is determined whether or not a player who is currently playing is a member (S243). This processing is to determine whether a holder of the IC card 1500 is a member by accessing a membership management server 13 based on an identification code of the IC card 1500 held by the card unit 1741. In addition, when membership authentication has already been conducted on the PTS terminal 1700 and a flag indicating a result of the authentication is stored in a RAM 1753 or an external storage device 1754, this determination may be conducted by referencing this flag. In the membership authentication, determination on a password inputted by a player may be made.

When a player who is playing is not a member, (NO at S243), the processing is returned to S242 and the determination on whether or not an IC card 1500 is held by the card unit 1741 is repeated. When a player is a member (YES at S243), control is performed so as to allow the power to be supplied from the power supply unit 1760 to the electronic device connected to the USB terminal (S244). The above-described control process can also be conducted, for example, after checking that the electronic device has been connected to the USB terminal.

Next, it is determined again whether or not the IC card 1500 is held by the card unit 1741 (S245). When the IC card 1500 is held by the card unit 1741 (YES at S245), the processing is returned to S245 and this determination is repeated. This process allows the recharging on the USB terminal to be sustained while a player has inserted the IC card 1500 to the card insertion slot 1730 and is playing a game.

When no IC card 1500 is held by the card unit 1741 (NO at S245), the processing is returned to S241 and the power supply to the USB terminal 1737 is interrupted. By conducting this process, when a player has terminated a game and ejected the IC card 1500, the power supply to the USB terminal is interrupted and the recharging is discontinued.

[Functionality of Home Button of PTS Terminal]

Next, with reference to FIG. 16 and FIG. 17, functionality of a home button 1722 of a PTS terminal 1700 will be described. In this example, the home button 1722 is a button physically provided on an LCD cover 1719*a* of the PTS terminal 1700, located at a position which is below an LCD 1719 and is on a right side (as shown in FIG. 6). A player presses this home button 1722, thereby shifting a screen displayed on the LCD 1719 to a predetermined upper level screen.

Figure 16A:
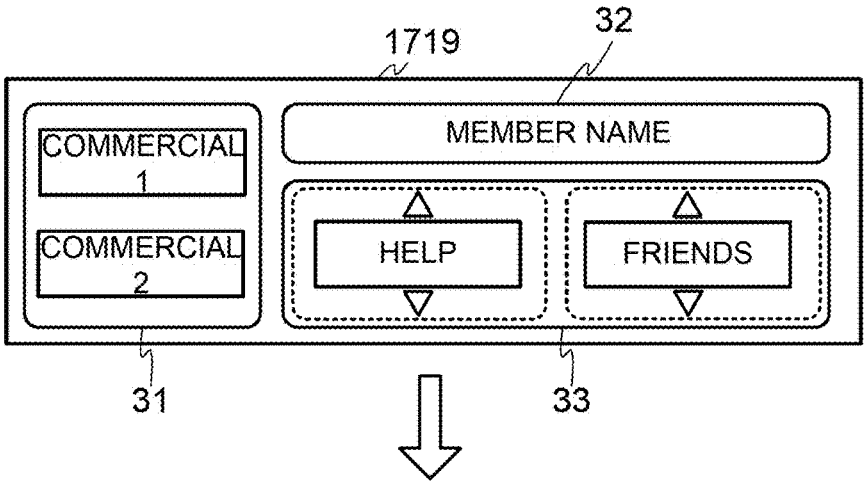
FIGS. 16A to 16C are diagrams illustrating one example of a display screen of a display device of the PTS terminal according to the one embodiment of the present invention.

FIG. 16A shows a menu screen 30 for a member displayed on the LCD 1719 of the PTS terminal 1700 after a player has inserted a membership card into a card insertion slot 1730 of the PTS terminal 1700 and has logged in as a member. Since as described above, the LCD 1719 is a display device having a small size of 6.2 inches, it is difficult to concurrently display many pieces of information.

In the menu screen 30 shown in FIG. 16A, an advertisement display part 31, a member name display part 32, and a service menu display part 33 are displayed. In this example, in the service menu display part 33, two service menus are concurrently displayed by two scroll displays. In the scroll display on a left side, a button of "HELP" service (help display service for displaying operation methods and the like of the PTS terminal 1700 and a slot machine 1010) is displayed, and in the scroll display on a right side, a button of a "FRIENDS" service (friend registration and friend search service) is displayed. In each of the scroll displays, an upper triangular display or a lower triangular display is touched, thereby displaying a button of other service menu.

Figure 16B:
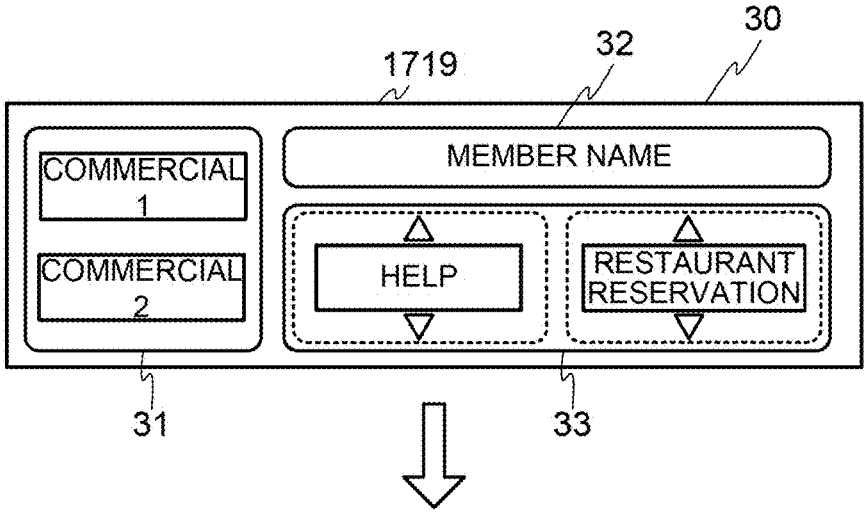

FIG. 16B shows a state in which the button of the other service menu, that is, "restaurant reservation" service is displayed by touching the lower triangular display in the scroll display on the right side in the menu screen 30 shown in FIG. 16A. When a player touches the button of the "restaurant reservation" service here, the display in the LCD 1719 is shifted to a top menu 34 for restaurant reservation shown in FIG. 16C.

As described above, on the PTS terminal 1700, a variety of service menus can be provided. For example, in addition to the above-mentioned restaurant reservation service, service for a floor guide, hotel reservation, point games, watching movies, a VoIP phone call (phone call between players), and text chatting among players is provided by said service menu. In addition, service for a reward, a drink order, present purchasing, and the like which use a credit in a membership card is also provided. [0186] The above mentioned respective service menus and a provision system of said service are realized, for example, such that HTML data, images, and the like are interpreted and displayed by a Web browser executed on the PTS terminal 1700. In this case, a hall management server 10 or the like functions as a WEB server and in response to a request by the Web browser of the PTS terminal 1700, transmits necessary data to the PTS terminal 1700.

Figure 16C:
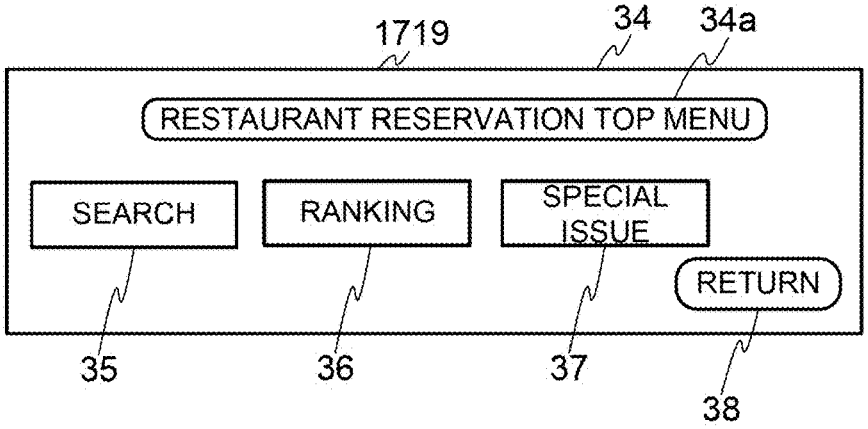

FIG. 16C shows the top menu 34 for the restaurant reservation, and a title display part 34*a*, a search button display part 35, a ranking button display part 36, a feature button display part 37, and a "return" button display part 38 are displayed therein. When a player touches any of the search button display part 35, the ranking button display part 36, and the feature button display part 37, a lower level screen corresponding thereto is displayed. The lower level screen is described later with reference to FIG. 17. In addition, when a player touches the "return" button display part 38, a CPU 1751 detects a position of the touch operation and shifts the display in the LCD 1719 to the menu screen 30 shown in FIG. 16B.

Figure 17:
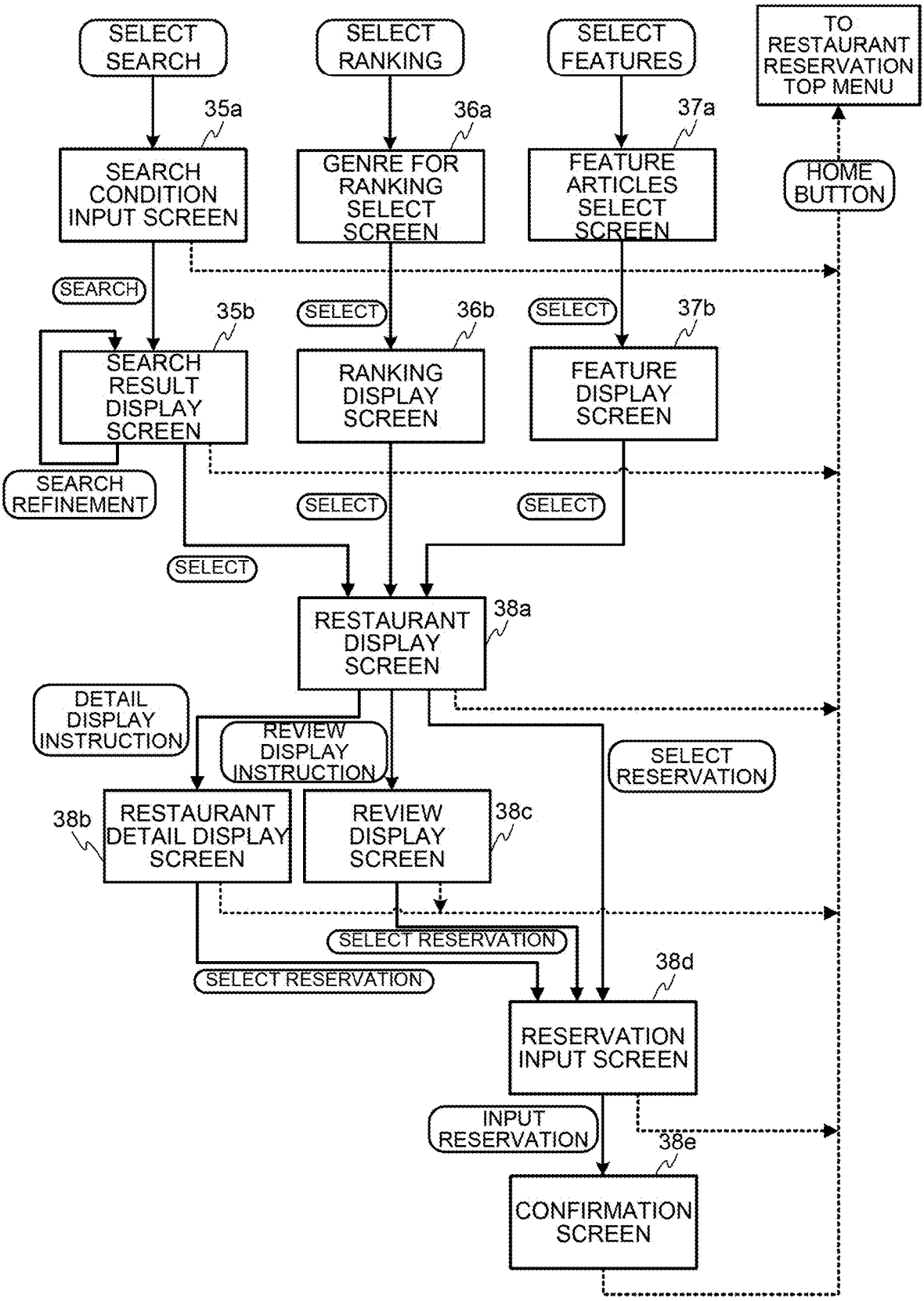
FIG. 17 is a diagram illustrating one example of screen shifting of the display screen of the display device of the PTS terminal according to the one embodiment of the present invention.

FIG. 17 is a diagram exemplifying screen shifting (mainly, screen shifting from the upper level screen to the lower level screen) in a case where each of the search button display part 35, the ranking button display part 36, and the feature button display part 37 is touched.

When in the top menu 34 for the restaurant reservation shown in FIG. 16C, the search button display part 35 is touched, a screen display in the LCD 1719 is shifted to a search condition input screen 35*a* (contents of display in details are omitted, and hereinafter, the same is applied to the other screens shown in FIG. 17). When a search condition is inputted there and a displayed search button is touched, the CPU 1751 detects a position of the touch operation and the screen display is shifted to a search result display screen 35*b* which list-displays a result of the search.

Here, when a narrowing-down condition is inputted and a narrowing-down button is touched, a narrowing-down search is conducted and a search result display screen 35*b* which list-displays a result thereof is displayed. When in the search result display screen 35*b*, a display portion of a desired restaurant is touched and selected, the screen display is shifted to a restaurant display screen 38*a* which displays information pertinent to the selected restaurant.

When in the restaurant display screen 38*a*, a detail display button which displays detailed information pertinent to the restaurant is touched, a restaurant detail display screen 38*b* is displayed, and when a word-of-mouth display button which displays word-of-mouth information is touched, a word-of-mouth display screen 38*c* is displayed.

In addition, when a reservation button displayed in the restaurant display screen 38*a* is touched, a reservation button displayed in the restaurant detail display screen 38*b* is touched, or a reservation button displayed in the word-of-mouth display screen 38*c* is touched, a reservation input screen 38*d* is displayed, and when reservation input is made there and a determination button is touched, the reservation of that restaurant is completed and a confirmation screen 38*e* is displayed.

On the other hand, when in the top menu 34 for the restaurant reservation shown in FIG. 16C, the ranking button display part 36 is touched, the screen display in the LCD 1719 is shifted to a ranking genre selection screen 36*a*, and when a genre for the ranking is inputted there and a displayed selection button is touched, the screen display is shifted to a ranking display screen 36*b* which list-displays a result of the ranking in the selected genre.

Here, when a display portion of a desired restaurant is touched and selected, the screen display is shifted to the restaurant display screen 38*a* which displays information pertinent to the selected restaurant. The subsequent screen shifts are the same as those in the case where the search button display part 35 is touched.

In addition, when in the top menu 34 for the restaurant reservation shown in FIG. 16C, the feature button display part 37 is touched, the screen display in the LCD 1719 is shifted to a feature article selection screen 37*a*, and when a title of the displayed feature article is touched there, the screen display is shifted a feature display screen 37*b* which displays a feature article of the selected title.

Here, when a display portion of a desired restaurant is touched and selected, the screen display is shifted to the restaurant display screen 38*a* which displays information pertinent to the selected restaurant. The subsequent screen shifts are the same as those in the case where the search button display part 35 is touched.

The home button 1722 is respectively pressed in the state in which each of the screens displayed in each of the screen shifts from the upper level screen to the lower level screen, related to the "restaurant reservation" service shown in FIG. 17, is displayed in the LCD 1719, the screen display is jumped to the top menu 34 (that is, the upper level screen) for the restaurant reservation shown in FIG. 16C without any conditions, shifting the image display in the LCD 1719 (see dotted arrows in FIG. 17).

It is to be noted that the screen shifts shown in FIG. 17 are merely examples, and screen shifts having larger number of levels (or smaller number of levels) can be configured and service is provided by various screen shifts for other service.

In addition, in this example, as shown in FIG. 16 and FIG. 17, a player presses the home button 1722, thereby allowing the display screen to return to the predetermined upper level screen, that is, the top menu of the service related to the screen displayed at this point in time even when a player is displaying any display screen. In addition, the home button 1722 also enables the display screen to jump to other predetermined upper level screen. For example, it is made possible to shift the display screen to the screen in the display state shown in FIG. 16A even when the screen for any of the service is displayed and to shift the display screen to the screen which is one level below the top menu (in this example, the search condition input screen 35*a*, the ranking genre selection screen 36*a*, the feature article selection screen 37*a*, or the like), in accordance with the displayed screen.

As described above, since the home button 1722 enables the display screen to jump to the predetermined screen, it is not required to arrange a button display part (icon) for returning each of the display screens to said predetermined screen on the screen of the LCD 1719. In a case where the button display part to be touched on the screen is arranged, in view of operability and visibility, it is required for the button display part to be of a size of a certain degree. Displaying this button on the small LCD as described above exerts an overload on a display area, thereby resulting in a reduction in an amount of information which can be displayed.

In the PTS terminal 1700 according to the present invention, the home button 1722 is physically provided, thereby allowing the overload exerted on the display area of the LCD 1719 to be avoided and as a result, enabling a larger amount of information to be displayed on the LCD 1719.

In addition, since upon pressing the home button 1722, the screen display is jumped to the predetermined screen, also when a player hesitates over the operation of the service menu or wants to redo the operation thereof, it is made possible to guide a player to the predetermined screen at once through the simple operation.

REFERENCE SIGNS LIST

1 game system
1010 slot machine
1011 cabinet
1016 symbol display device
1030 control panel
1700 PTS terminal
1722 home button
1741 card unit
1745 touch unit
1750 PTS controller
1759 USB control part

The invention claimed is:

1. A player tracking device being integrated into a gaming machine, comprising:
- an IC card writer that stores information pertinent to a play outcome on the gaming machine in an IC card through wireless communication;
- an IC device reader that reads information from an IC device including an IC chip through the wireless communication, the IC device being a device different from the IC card; and
- a controller of the player tracking device that:
  - controls the IC card writer to take in and hold the IC card during a game play on the gaming machine; and
  - controls, in response to approaching of the IC device to the IC device reader, the IC device reader to read the information from the IC device,
- wherein the IC device reader is capable of reading the information from the IC device while the IC card writer holds the IC card for the game play on the gaming machine.

2. The player tracking device according to claim 1, wherein the information read from the IC device is information pertinent to maintenance for the gaming machine.

3. A gaming machine on which based on rearranged symbols, a payout is awarded, comprising:
- a display device for displaying a plurality of reels, each of the reels having a plurality of symbols depicted on an external surface;
- a cabinet for internally housing the display device;
- a controller for rotating and stopping the plurality of reels and controlling the symbols depicted on the plurality of reels to be rearranged; and
- the player tracking device according to claim 1 which is incorporated into the cabinet.

4. The player tracking device according to claim 2, further comprising:
- a USB terminal to which an electronic device is connected,
- wherein the controller of the player tracking device:
- based on the information in the IC card, determines whether or not the IC card is an IC card of a member; and
- when the IC card is determined to be the IC card of the member, performs control such that power is supplied to the USB terminal and the electronic device connected to the USB terminal is caused to be in a rechargeable state.

5. A player tracking device being integrated into a gaming machine, comprising:

a display device that displays information pertinent to service related to a game executed on the gaming machine;

a physical button that shifts a screen displayed on the display device to other screen when the physical button is pressed;

a first unit including an IC card writer that stores information pertinent to a play outcome on the gaming machine in an IC card through wireless communication;

a second unit including an IC device reader that reads information from an IC device including an IC chip through the wireless communication; and a controller of the player tracking that:

when a position of a touch operation onto the display device is detected, at this point in time, shifts the screen displayed on the display device to the other screen in accordance with the position on the display device; and when the physical button is pressed, at this point in time, shifts the screen displayed on the display device to a predetermined upper level screen related to the screen displayed on the display device, wherein the position of the touch operation selects any one of a plurality of menus included in the screen displayed on the display device, wherein the screen displayed on the display device is shifted to the other screen corresponding to the menu selected in accordance with the touch operation, wherein the predetermined upper level screen is a screen in which a plurality of selections according to a plurality of touch operations are initialized, and wherein the second unit is capable of reading the information from the IC device while the first unit holds the IC card for the game play on the gaming machine.

6. A gaming machine on which based on rearranged symbols, a payout is awarded, comprising:

a display device for displaying a plurality of reels, each of the reels having a plurality of symbols depicted on an external surface;

a cabinet for internally housing the display device;

a controller for rotating and stopping the plurality of reels and controlling the symbols depicted on the plurality of reels to be rearranged; and the player tracking device according to claim 5 which is incorporated into the cabinet.

7. A player tracking device being integrated into a gaming machine, comprising:

a first unit including an IC card writer that stores information pertinent to a play outcome on the gaming machine in an IC card through wireless communication;

a second unit including an IC device reader that reads information from an IC device including an IC chip through the wireless communication; and a controller of the player tracking device that:

controls the first unit to take in and hold the IC card during a game play on the gaming machine;

controls the second unit to read the information of the IC device from the IC device; and in a case where the second unit reads the information of the IC device, transmits information pertinent to maintenance of the gaming machine to a server connected to the player tracking device, wherein the second unit is capable of reading the information from the IC device while the first unit holds the IC card for the game play on the gaming machine.

* * * * *